US009098005B2

(12) United States Patent
Kawata et al.

(10) Patent No.: US 9,098,005 B2
(45) Date of Patent: Aug. 4, 2015

(54) IMAGE FORMING APPARATUS

(75) Inventors: Kentaro Kawata, Suntou-gun (JP); Takuya Kitamura, Numazu (JP); Takayuki Kanazawa, Suntou-gun (JP); Yuji Kawaguchi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 327 days.

(21) Appl. No.: 13/155,981

(22) Filed: Jun. 8, 2011

(65) Prior Publication Data

US 2011/0311254 A1 Dec. 22, 2011

(30) Foreign Application Priority Data

Jun. 21, 2010 (JP) ..... 2010-140911

(51) Int. Cl.
*G03G 15/00* (2006.01)
*G03G 15/01* (2006.01)
*G03G 15/06* (2006.01)

(52) U.S. Cl.
CPC ..... *G03G 15/0173* (2013.01); *G03G 15/065* (2013.01)

(58) Field of Classification Search
CPC ..... G03G 15/00; G03G 15/01; G03G 15/06; G03G 15/08; G03G 15/0812; G03G 13/01; G03G 2215/0177
USPC ..... 399/53, 46, 75, 76, 107, 110, 116, 119, 399/148, 222, 223, 227, 226, 228, 252, 265
See application file for complete search history.

(56) References Cited

U.S. PATENT DOCUMENTS

| | | | | |
|---|---|---|---|---|
| 5,835,825 | A * | 11/1998 | Maruta | 399/227 |
| 7,292,800 | B2 * | 11/2007 | Miyazawa et al. | 399/53 |
| 2002/0031360 | A1 * | 3/2002 | Umezawa et al. | 399/67 |
| 2002/0061203 | A1 * | 5/2002 | Akaike et al. | 399/75 |
| 2005/0141938 | A1 * | 6/2005 | Yoshizuka | 399/394 |
| 2006/0039720 | A1 | 2/2006 | Miyazawa | |
| 2008/0080884 | A1 * | 4/2008 | Yamane | 399/56 |
| 2009/0110445 | A1 * | 4/2009 | Yamada | 399/284 |
| 2009/0297222 | A1 * | 12/2009 | Kawamura | 399/167 |
| 2009/0304414 | A1 * | 12/2009 | Hamada | 399/270 |
| 2009/0317143 | A1 * | 12/2009 | Hamada | 399/270 |
| 2010/0303488 | A1 * | 12/2010 | Yanagi | 399/45 |

(Continued)

FOREIGN PATENT DOCUMENTS

| | | |
|---|---|---|
| CN | 101419420 A | 4/2009 |
| JP | 08-305159 A | 11/1996 |

(Continued)

*Primary Examiner* — Benjamin Schmitt
*Assistant Examiner* — Matthew Miller
(74) *Attorney, Agent, or Firm* — Canon USA Inc IP Division

(57) ABSTRACT

An image forming apparatus includes a rotatable image bearing member configured to bear an electrostatic latent image, a plurality of development devices including a developer bearing member configured to bear a developer for developing the electrostatic latent image, a rotatable development device supporting member configured to support the plurality of development devices. The developer bearing member is configured to execute development while contacting the image bearing member at a development position via the developer, rotating in the same direction as rotating direction of the image bearing member at the development position, and rotating at a speed faster than a surface speed of the image bearing member.

6 Claims, 15 Drawing Sheets

(56) References Cited

U.S. PATENT DOCUMENTS

| | | | | |
|---|---|---|---|---|
| 2011/0150513 | A1* | 6/2011 | Kawata et al. | 399/55 |
| 2013/0243454 | A1* | 9/2013 | Ishihara et al. | 399/45 |

FOREIGN PATENT DOCUMENTS

| | | | |
|---|---|---|---|
| JP | 08305159 | A * | 11/1996 |
| JP | 2005-148319 | A | 6/2005 |

* cited by examiner

IMAGE FORMING APPARATUS

BACKGROUND OF THE INVENTION

1. Field of the Invention

The present invention relates to a color electrophotographic image forming apparatus which employs a rotary type development process.

2. Description of the Related Art

A conventional full color image forming apparatus has been widespreadly known, which includes one image bearing member and a rotatable supporting member that integrally supports a plurality of development devices. The image forming apparatus like this employs a development process for developing an electrostatic latent image that has been formed on the surface of an image bearing member by sequentially changing a development device at a predetermined timing. The image forming apparatus which uses the rotatable development device supporting member (rotary) like this, which integrally supports a plurality of development devices and which is configured to develop an electrostatic latent image formed on the surface of one image bearing member by sequentially changing the development device, is referred to as a "rotary type image forming apparatus".

Japanese Patent Application Laid-Open No. 2005-148319 discusses a configuration of the conventional rotary type image forming apparatus. Generally, in the rotary type development process, it is necessary, for each development device provided to each color developer, to execute an operation, at a development position, for sequentially causing a developer bearing member of each development device to abut on and separate from the surface of the image bearing member. The development device is changed by rotating the development device supporting member while the development device is separated from the surface of the image bearing member.

In the conventional image forming apparatus, the operation for causing the developer bearing member to abut on and separate from the surface of the image bearing member is executed by moving the development device supporting member in the direction of the diameter of the image bearing member (in the direction of the rotational axis) by a cam having a driving force. However, the following problem may arise in the above-described conventional rotary type image forming apparatus.

Specifically, in the conventional image forming apparatus, because the image forming apparatus executes the operation for causing the developer bearing member to abut on and separate from the surface of the image bearing member by moving the development device supporting member in the direction of the diameter of the image bearing member, it becomes necessary to provide a space for moving the development device supporting member. In addition, in the above-described conventional image forming apparatus, it becomes necessary to provide a cam as a drive unit for moving the development device supporting member in the direction of the diameter of the image bearing member during the operation for causing development device supporting member abut on or separate from the surface of the image bearing member.

To paraphrase this, in the conventional rotary type image forming apparatus, it becomes necessary to provide a space and a drive unit for causing the developer bearing member to abut on and separate from the surface of the image bearing member by moving the entire development device supporting member in the direction of diameter of the image bearing member. Accordingly, it becomes difficult neither to reduce the size of the apparatus body nor to reduce the cost.

For example, the above-described problem may be solved by the following configuration. Specifically, the operation for causing the developer bearing member to abut on and separate from the surface of the image bearing member may be executed by directly utilizing the rotation of the development device supporting member instead of using a drive unit, such as a cam.

However, if the operation for causing the developer bearing member to abut on and separate from the surface of the image bearing member by directly utilizing the rotation of the development device supporting member, the developer applied to the surface of the developer bearing member may adhere to the surface of the image bearing member in a streak-like shape during the abutment and the separation operation. As a result, image defect may arise.

SUMMARY OF THE INVENTION

The present invention is directed to a rotary type image forming apparatus, which can be capable of achieving a high image quality as well as downsizing of an apparatus main body and reducing a cost According to an aspect of the present invention, an image forming apparatus includes a rotatable image bearing member configured to bear an electrostatic latent image, a plurality of development devices including a developer bearing member configured to bear a developer for developing the electrostatic latent image, a rotatable development device supporting member configured to support the plurality of development devices. In the image forming apparatus, the developer bearing member is configured to execute development while contacting the image bearing member at a development position via the developer, rotating in the same direction as rotating direction of the image bearing member at the development position, and rotating at a speed faster than a surface speed of the image bearing member. In addition, the development device supporting member is configured to rotate in the same direction of a rotating direction of the image bearing member at a position where the development device supporting member and the image bearing member are facing each other, and change a developer bearing member existing at the development position to another developer bearing member by rotating. Furthermore, a relative speed of a surface moving speed of the developer bearing member with respect to a surface moving speed of the image bearing member when the developer bearing member abuts on or separates from the image bearing member due to the rotation of the development device supporting member becomes higher than a relative speed of the surface moving speed of the developer bearing member with respect to the surface moving speed of the surface of the image bearing member when the electrostatic latent image is developed, and a control unit configured to control a first potential difference, which is a potential difference between a potential of a bias applied to the developer bearing member when the developer bearing member abuts on or separates from the image bearing member and a potential of the image bearing member at the development position becomes higher than a second potential difference, which is a potential difference between the potential of the bias applied to the image bearing member and a potential of a non-imaging portion of the image bearing member at the development position.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the present invention.

DESCRIPTION OF THE EMBODIMENTS

Various exemplary embodiments, features, and aspects of the invention will be described in detail below with reference to the drawings.

The dimension, the properties of the materials, and the shape of the components illustrated in the following exemplary embodiments of the present invention and the relative positional relationship between the components can be appropriately changed or modified according to the configuration of an apparatus to which the present invention can apply and according to various conditions and may not limit the scope of the present invention to the following exemplary embodiments.

Figure 1:
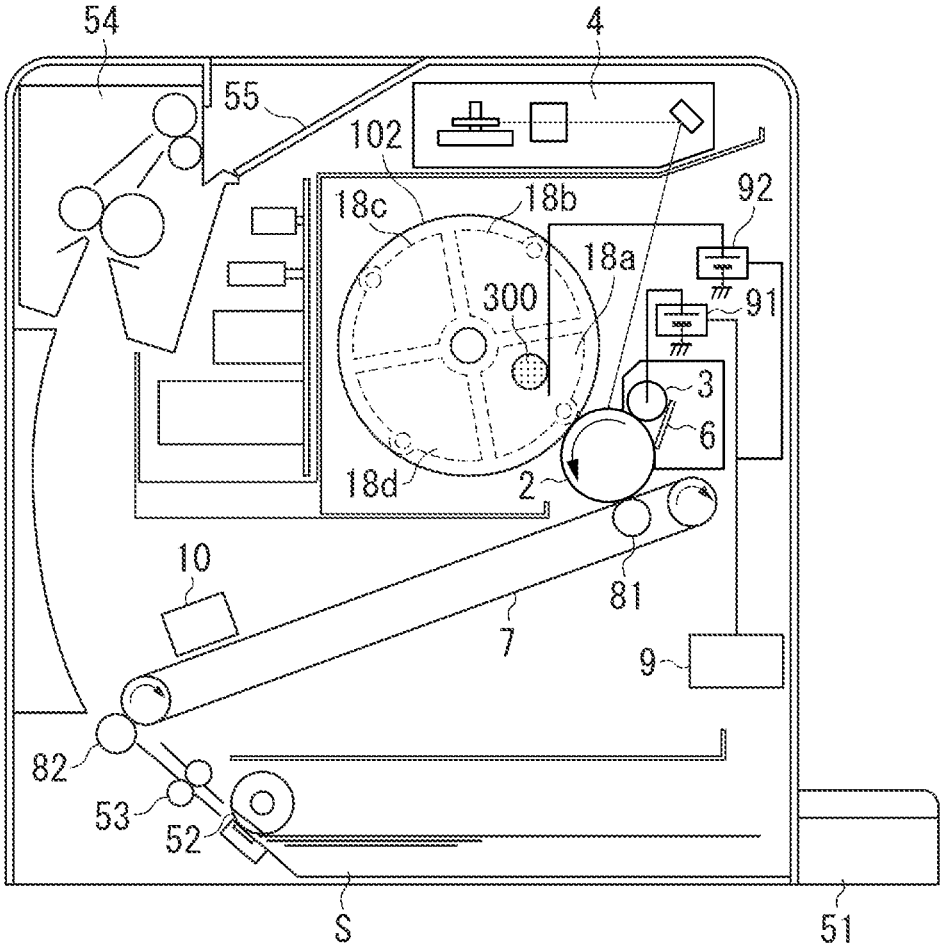
FIG. 1 illustrates an exemplary configuration of an image forming apparatus according to a first exemplary embodiment of the present invention.

An image forming apparatus according to a first exemplary embodiment of the present invention will be described in detail below with reference to FIGS. 1 through 8. FIG. 1 illustrates an exemplary configuration of the image forming apparatus according to the present exemplary embodiment.

In the present exemplary embodiment, a rotary type color laser printer (electrophotographic type) is used as the image forming apparatus. The color laser printer includes a rotatable photosensitive drum 2 (image bearing member).

Around the photosensitive drum 2, a charge roller 3, an exposure device 4, and a cleaning device 6 are provided. The charge roller 3 evenly charges the surface of the photosensitive drum 2. The exposure device 4 irradiates the surface of the photosensitive drum 2 with a laser beam to form an electrostatic latent image on the surface of the photosensitive drum 2. The cleaning device 6 cleans the surface of the photosensitive drum 2.

In addition, development devices 18*a* through 18*d* are provided for each color of the developer (yellow, magenta, cyan, and black). The development devices 18*a* through 18*d* supplies the developer to the electrostatic latent image formed on the surface of the photosensitive drum 2 to develop a developer image.

The development devices 18*a* through 18*d* are supported integrally by a rotary 102 (development device supporting member). The rotary 102, which has a substantially circular shape, can rotate in the forward direction with respect to the rotation direction of the photosensitive drum 2.

The rotary 102 is configured to be rotatable to control each of the development devices 18*a* through 18*d* to be moved to a development position opposed to the photosensitive drum 2 by a drive executed by the following drive mechanism. Each of the development devices 18*a* through 18*d* can be configured to be detachable from the rotary 102. With the above-described configuration, a replenishment of the developer and a maintenance operation can be executed separately for each development device. Accordingly, the user convenience can be improved.

In the example illustrated in FIG. 1, a drive input member 300, which is installed on the image forming apparatus body, engages a coupling member 200 (described below), which is installed on the development device 18. With the above-described configuration, a development roller 182 (developer bearing member) of the development device 18 can be rotated and driven. The engagement between the drive input member 300 and the coupling member 200 will be described below.

A direct current (DC) high voltage power source 91 applies a voltage to the charge roller 3. A DC high voltage power source 92 applies a voltage to the development devices 18*a* through 18*d*. A control device 9 is a control unit configured to control on/off of the DC high voltage power source 91 and the DC high voltage power source 92. In addition, the control device 9 controls the level of a bias voltage to be applied and the variation of the level of the applied voltage. Furthermore, the control device 9 controls the operation of the rotary 102.

Figure 14:
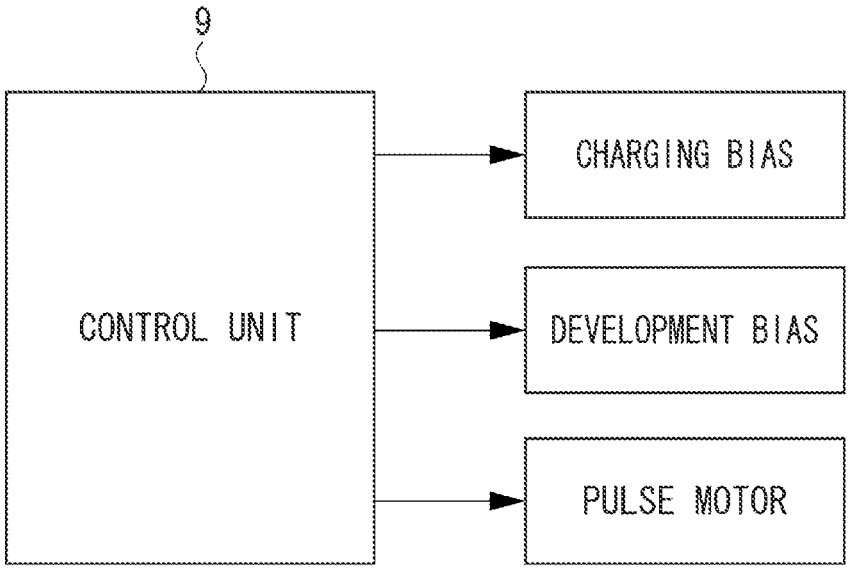
FIG. 14 is a block diagram illustrating a correlation between a control apparatus and a power supply controlled by the control apparatus.

FIG. 14 is a block diagram illustrating an exemplary correlation between the control device 9 and each of the DC high voltage power source 91, which applies a voltage to the charge roller 3 that operates under control of the control device 9, the DC high voltage power source 92 configured to apply a voltage to the development device 18, and a pulse motor configured to control the driving of the rotary 102. The rotary 102 is rotated by the pulse motor (not illustrated). The rotary 102 can rotate to change the development roller existing at the development position to another development roller of another color.

In forming an image on a sheet material S (recording paper), at first, the photosensitive drum 2 is rotated in the direction indicated with an arrow in FIG. 1 (i.e., in the counterclockwise direction) in synchronization with the rotation of an intermediate transfer belt 7. Furthermore, the charge roller 3 evenly charges the surface of the photosensitive drum 2 and the exposure device 4 irradiates light of a yellow image (exposure). In this manner, an electrostatic latent image corresponding to a yellow image is formed on the surface of the photosensitive drum 2.

Before the electrostatic latent image is formed, the rotary 102 is driven by a drive force transmission mechanism, which will be described below, and the yellow development device 18*a* is rotated to be moved to a position at which the yellow development device 18*a* is opposed to the photosensitive drum 2 (i.e., a development position). At the development position, a voltage of the same polarity as the polarity of the developer is applied to the rotatable development roller 182*a* (developer bearing member) of the development device 18*a*. Accordingly, the yellow developer adheres to the electrostatic latent image on the photosensitive drum 2. In this manner, the electrostatic latent image can be developed as a developer image.

The electric contact provided to the image forming apparatus body for feeding power to the development device 18 and the electric contact provided to the development device 18 are having conduction before the development device 18 reaches the development position and after the development device 18 goes through the development position. With the above-described configuration, the development bias voltage can be applied with a sufficient range across the development position.

An apparatus body electric contact 400 feeds the bias to the development roller which is installed on the apparatus body. The apparatus body electric contact 400 is fixedly installed at the development position, at which the development roller is opposed to the photosensitive drum 2.

Development device electric contacts 189*a* through 189*d* are installed on the rotary 102 at its development device installation locations. When the development device is mounted, the development device electric contacts 189*a* through 189*d* become abutment state on a cored bar of the development roller. In this state, the relative positional relationship between the development device electric contacts 189*a* through 189*d* and the cored bar is fixed. In the following description, the cored bar of the development rollers 182*a* through 182*d* and the development device electric contacts 189*a* through 189*d* provided on the rotary 102 are collectively referred to as a "contact point of the development device 18".

After developing the developer image, the development roller 182*a* is driven by the rotary 102 to be separated from the surface of the photosensitive drum 2. Subsequently, a voltage having the polarity reverse to the polarity of the developer is applied to a primary transfer roller 8, which is provided inside the intermediate transfer belt 7. In this manner, the developer image formed on the surface of the photosensitive drum 2 is primarily transferred onto the intermediate transfer belt 7.

After the yellow developer image is completely primary-transferred in the above-described manner, the rotary 102 resumes its rotation. Accordingly, the development device 18 is sequentially changed from the yellow development device 18*a* to each of the development device 18*b*, 18*c*, and 18*d*, which corresponds to the colors of magenta, cyan, and black, respectively.

After each development device 18 is positioned at the development position, at which the development device 18 is opposed to the photosensitive drum 2, the development and the primary transfer are sequentially executed for each of the colors of magenta, cyan, and black similarly to the color of yellow. As a result, four-color developer images are transferred on the intermediate transfer belt 7 in a mutually superposed manner.

A secondary transfer roller 82 is in a non-contact state with the intermediate transfer belt 7 while each color developer image is primarily transferred on the intermediate transfer belt 7. In addition, a cleaning unit 10, which cleans the intermediate transfer belt 7, is in non-contact state with the intermediate transfer belt 7 either.

On the other hand, the sheet materials S are stacked and stored in a paper feed cassette 51, which is provided in the lower portion of the apparatus main body. The sheet materials S are separated and fed sheet by sheet by a paper feed roller 52 from the paper feed cassette 51 to a registration roller pair 53.

The registration roller pair 53 conveys the fed sheet material S to a nip portion formed between the intermediate transfer belt 7 and the secondary transfer roller 82. The secondary transfer roller 82 and the intermediate transfer belt 7 press contact against each other at the nip portion as illustrated in FIG. 1.

In executing the secondary transfer for transferring the developer image on the sheet material S, at first, the sheet material S is conveyed to the nip portion. Subsequently, a voltage of the polarity reverse to the polarity of the developer is applied to the secondary transfer roller 82. In the above-described manner, developer images on the intermediate transfer belt 7 can be secondarily transferred in a lump onto the surface of the sheet material S.

The sheet material S having the secondarily transferred developer image thereon is then conveyed to a fixing device 54. The fixing device 54 applies heat and pressure to the sheet material S to fix the developer image onto the sheet material S. Subsequently, the sheet material S is discharged from the fixing device 54 onto a paper discharge unit, which is provided on a top cover 55 of an external of the apparatus main body.

Figure 2:
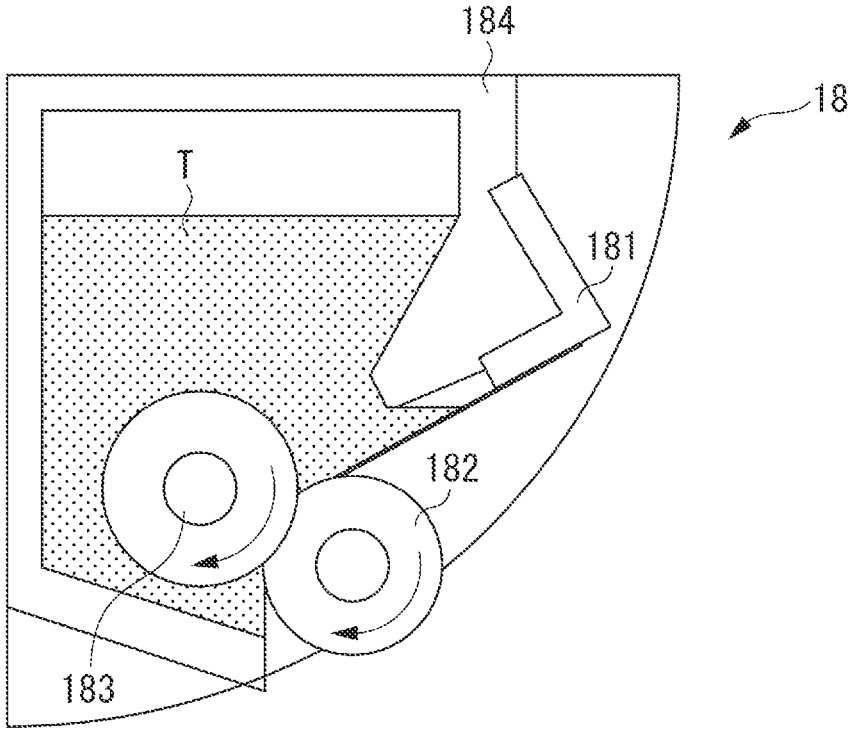
FIG. 2 illustrates an exemplary configuration of a development device according to the first exemplary embodiment of the present invention.

An exemplary configuration of the development device 18*a* through 18*d* according to the present exemplary embodiment will be described in detail below with reference to FIG. 2. In the present exemplary embodiment, the development devices 18*a* through 18*d* have the same configuration. Accordingly, the development devices 18*a* through 18*d* will not be respectively described in detail and will be described collectively as the development device 18.

In the present exemplary embodiment, the development device 18 uses a contact development method. The contact-development type development device 18 includes the development roller 182, which is the developer bearing member, regulation blades 181, a developer feed roller 183, and a developer container 184.

The development roller 182 is configured to be rotatable and to supply the developer to the electrostatic latent image, which is previously formed on the surface of the photosensitive drum 2, by contacting the surface of the photosensitive drum 2 while rotating with the developer born on the surface of the development roller 182. In the present exemplary embodiment, the development roller 182 rotates in the forward direction with respect to the rotation direction of the photosensitive drum 2. Furthermore, the peripheral speed that is 160% of the peripheral speed of the photosensitive drum 2 is set to the development roller 182.

In the present exemplary embodiment, the development roller 182 has the following configuration. Specifically, silicon rubber is bonded to the outer periphery of a stainless used steel (SUS) cored bar as the base layer and a urethane resin is used to coat the surface of the development roller 182. In addition, a thin SUS plate having the thickness of 80 μm is used for the regulation blades 181. The regulation blades 181 are oriented against the rotation direction of the development roller 182. With the above-described configuration, the amount of coating on the development roller 182, which is implemented with the developer, can be restricted in association with the rotation of the development roller 182.

As the developer supply roller 183, a cored bar around whose outer periphery a urethane sponge is windingly provided is used. The developer is first contained inside the developer feed roller 183 and then is supplied to the surface of the development roller 182 at the contact portion between the developer feed roller 183 and the development roller 182.

The development roller 182 and the developer feed roller 183 rotate in the same direction. To paraphrase this, at the contact portion between the development roller 182 and the developer feed roller 183, the surfaces of the development roller 182 and the developer feed roller 183 travel in a direction opposite to each other.

When the development device 18 is positioned to the development position by the operation described below to start image forming on the photosensitive drum 2, a predetermined voltage is applied to each member of the development device 18. For example, in the present exemplary embodiment, at a development start timing, the photosensitive drum 2 has the potential of −500 V in its non-exposed portion and the potential of −150 V in its exposed portion. Furthermore, at this timing, the voltage of about −350 V is applied to each of the development roller 182, the regulation blades 181, and the developer feed roller 183.

With the above-described potential setting, the developer having the negative polarity may not adhere to the non-exposed portion of the photosensitive drum 2 and adheres to the exposed portion of the photosensitive drum 2 by the electrostatic force. In the present exemplary embodiment, the development roller 182, the developer feed roller 183, and the regulation blades 181 have the same potential as described above. However, the present exemplary embodiment is not limited to this. More specifically, the development roller 182, the developer feed roller 183, and the regulation blades 181 can have different potentials.

Now, an exemplary method for transmitting the drive force to the development rollers 182*a* through 182*d* according to the present exemplary embodiment will be described in detail below with reference to FIGS. 3 through 5.

In the present exemplary embodiment, the rotational drive force is transmitted to the development roller 182 by way of a drive source (not illustrated), the drive input member 300, which is provided to the apparatus main body, the coupling member 200, which is provided to the development device, gears 185 and 186, and the development roller 182 (and the developer feed roller 183). In the following description, the method for transmitting the drive force will be described focusing on each member.

Figure 3:
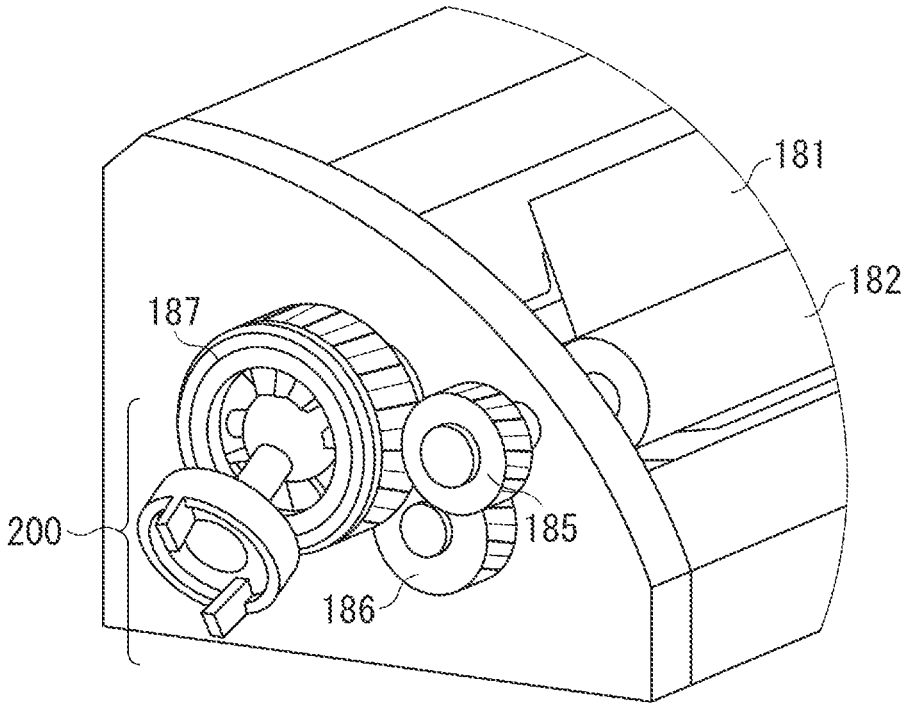
FIG. 3 illustrates an exemplary configuration of a coupling member of a development device according to the first exemplary embodiment of the present invention.

FIG. 3 illustrates the side of the development roller 182 of the development device 18 in the axis direction. Referring to FIG. 3, the gear 185 is provided on the edge of the cored bar of the development roller 182. The gear 186 is provided on the edge of the cored bar of the developer feed roller 183 (not illustrated in FIG. 3). The gears 185 and 186 engage each other.

The gear 185 also engages a drive input gear 187. The drive input gear 187 receives the rotational drive force transmitted from the drive source, which will be described below. The rotational drive force is transmitted from the drive input member 300 which is installed on apparatus main body to the gears 185 and 186 via the coupling member 200 and the drive input gear 187 provided inside the development device 18.

Now, the drive input member 300, which is provided to the apparatus main body and which engages the coupling member 200 included in the development device 18, will be described below with reference to FIGS. 4A through 4C.

Figure 4A:
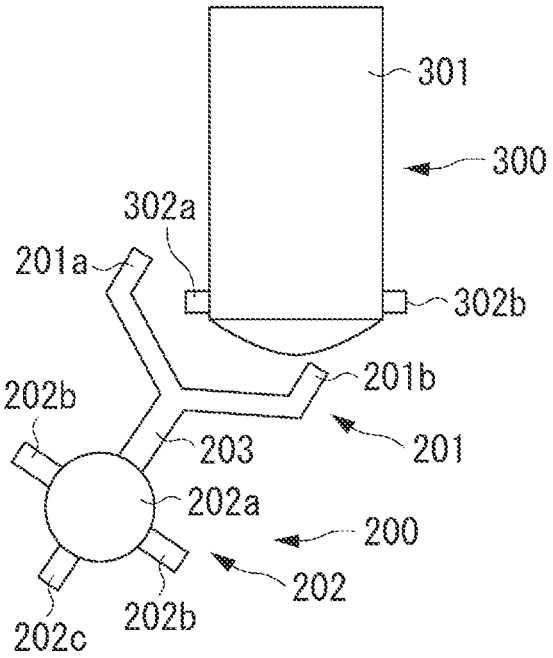
FIGS. 4A through 4C illustrate an exemplary configuration of a coupling member of the development device according to the first exemplary embodiment of the present invention.
Figure 4B:
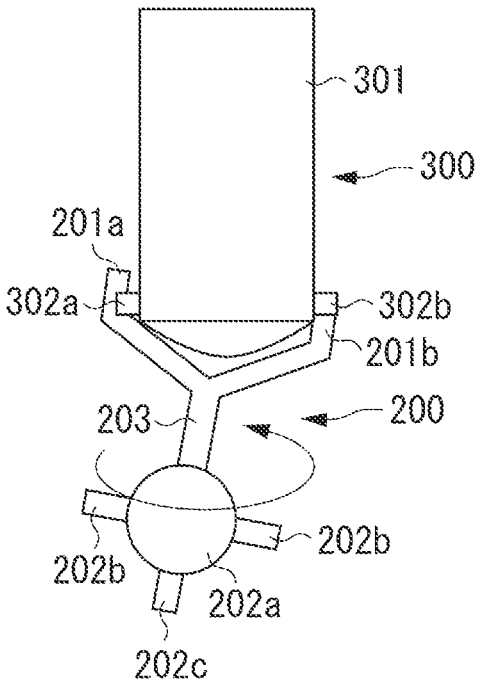
Figure 4C:
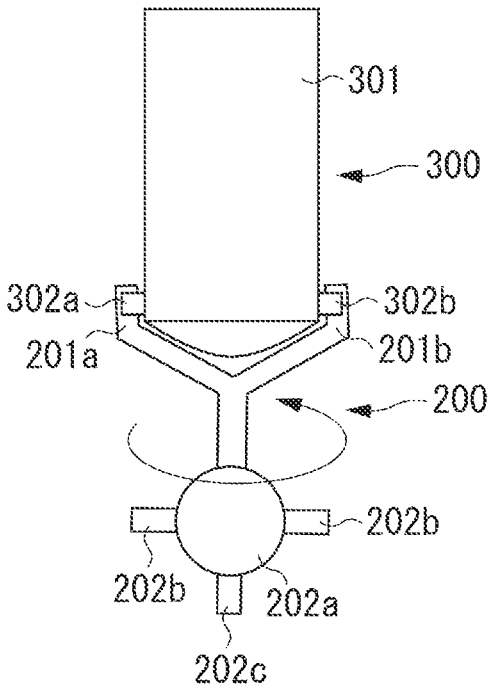

FIGS. 4A through 4C illustrate the engagement between the coupling member 200 included in the development device 18 and the drive input member 300 included in the apparatus main body. Specifically, FIG. 4A illustrates a state in which the development device coupling member 200 has not engaged the apparatus main body drive input member 300 yet. FIG. 4B illustrates a state in which the coupling member 200 has engaged the drive input member 300 before the development device 18 reaches the development position. FIG. 4C illustrates a state in which the coupling member 200 has engaged the drive input member 300 while the development device exists at the development position.

Referring to FIG. 4A, in the present exemplary embodiment, the drive input member 300 includes a drive shaft 301 and pins (protruded portions) 302*a* and 302*b*. The pins 302*a* and 302*b* are inserted into the drive shaft 301 at the periphery of the drive shaft 301 in the direction perpendicular to the drive shaft 301. The pins 302*a* and 302*b* engage the coupling member 200. Accordingly, the rotational drive force can be transmitted from the drive input member 300 to the coupling member 200. To paraphrase this, the pins 302*a* and 302*b* function as a rotational force application member of the drive input member 300.

On the other hand, the rotational force is transmitted from the drive source (not illustrated) to the drive shaft 301. In the present exemplary embodiment, the drive shaft 301 receives the rotational force from the drive source when image forming is started and continues to rotate regardless of whether the development device 18 exists at the development position.

The coupling member 200, which is installed on the development device 18, primarily includes three portions. Specifically, firstly, the coupling member 200 includes a driven portion 201. Referring to FIG. 4C, the driven portion 201 engages the pins 302*a* and 302*b* of the drive shaft 301 provided to the apparatus body.

Furthermore, claws 201*a* and 201*b*, which are provided to the driven portion 201 at two locations, engage the two pins 302*a* and 302*b*, which are rotation force application members provided on the drive shaft 301. Accordingly, the driven portion 201 can receive the rotational drive force from the pins 302*a* and 302*b*.

Secondly, the drive unit 202 is included in the coupling member 200 as its primary portion. The drive unit 202 is constituted by the spherical portion 202*a*, the pin 202*b*, and the tilt angle regulation member 202*c*. The pin 202*b* engages within the development device 18 to transmit the rotational force. The tilt angle regulation member 202*c* regulates the tilt of the coupling member 200.

Furthermore, the pin 202*b*, which is provided in development device 18, engages the drive input gear 187 (a rotational force receiving unit or a rotational force transmission target unit in FIG. 3). With the above-described configuration, the rotational drive force can be transmitted to the gears 185 and 186 described above.

In addition, the tilt angle regulation member 202*c* is inserted into a regulation groove, which is provided to the development device 18. When the tilt angle regulation member 202*c* is inserted into the regulation groove, the orientation of the coupling member 200 can be regulated along the regulation groove.

For the third primary portion, the coupling member 200 includes an intermediate portion 203, which connects the driven portion 201 and the drive unit 202 together. In the present exemplary embodiment, before the coupling member 200 engages the drive input member 300, the coupling member 200 is inclined at an angular position before the engagement (i.e., into the state illustrated in FIG. 4A).

Figure 5:
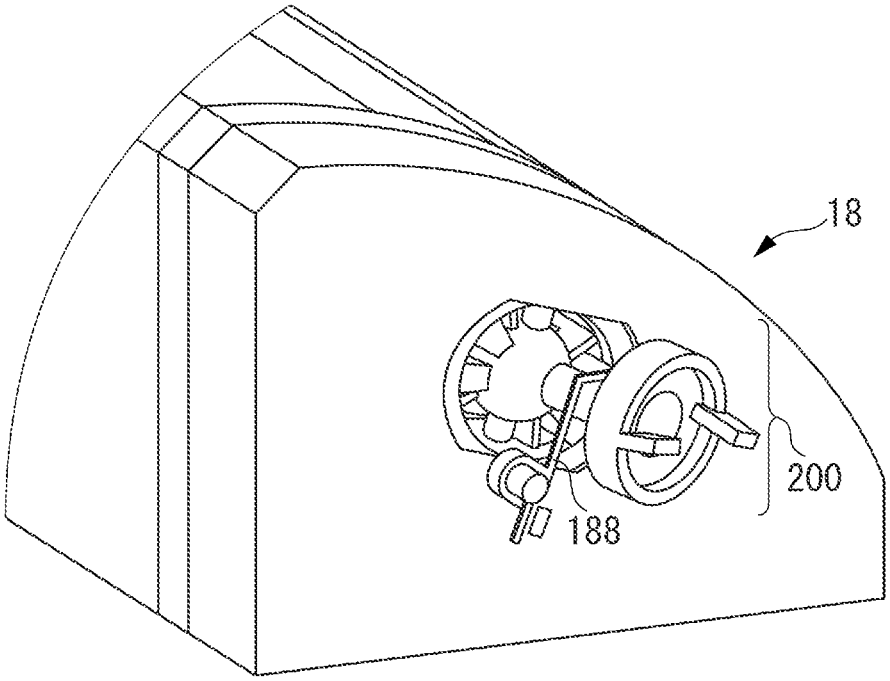
FIG. 5 illustrates an exemplary configuration of a coupling member of the development device according to the first exemplary embodiment of the present invention.

More specifically, the coupling member 200 is inclined as described FIG. 5 by hooking a bias spring 188 onto the intermediate portion 203. Furthermore, the coupling member 200 is previously inclined in a direction in which a leading edge of the coupling member 200 (i.e., a leading edge of the coupling member 200 closer to the driven portion 201) moves to receive the drive shaft 301 when the rotary 102 is rotated (i.e., state illustrated in FIG. 4A).

By controlling the coupling member 200 to be inclined to the drive shaft 301 in the above-described manner, the drive input member 300, which is provided to the apparatus main body, and the coupling member 200, which is provided to the development device 18, can engage before the development device 18 reaches the development position. More specifically, in the present exemplary embodiment, when the development position exists at a position of the angle of 0°, the coupling member 200 and the drive input member 300 can be engaged together at a location at which the rotational angle of the rotary 102 is slightly short of the angle of 7° as illustrated in FIG. 4B. When the development device 18 exists at the development position, the drive shaft 301 and the center of the coupling member 200 exist substantially in the same straight line as illustrated in FIG. 4C.

Now, the rotary (the development device supporting member) 102 and peripheral members thereto according to the present exemplary embodiment will be described below with reference to FIG. 6.

Figure 6:
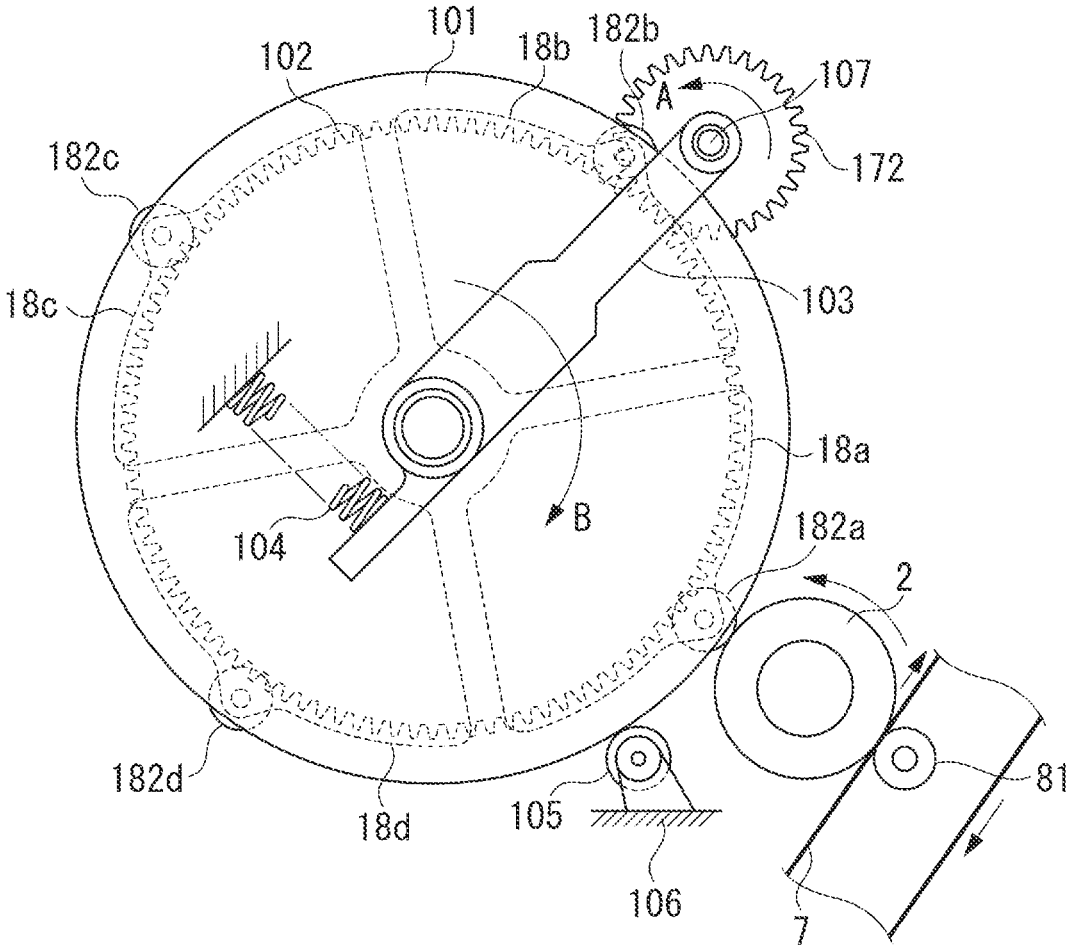
FIG. 6 illustrates an exemplary configuration of a rotary and a peripheral member thereof according to the first exemplary embodiment of the present invention.

In the example illustrated in FIG. 6, the development roller 182*a*, which is rotatably supported by the development device 18*a*, is currently developing the electrostatic latent image formed on the photosensitive drum 2 (i.e., the development roller 182*a* is in a state of abutment on the photosensitive drum 2). The rotary 102, which is a rotatable member having a substantially circular shape, has gear teeth formed on its outer periphery. The gear teeth engage a drive gear 172.

More specifically, the drive force is transmitted from the drive source (not illustrated) to the drive gear 172 to rotate the rotary 102. When the drive gear 172 is rotated in a direction A in FIG. 6, the rotary 102 is rotated in a direction B in FIG. 6. When the drive gear 172 stops, the rotary 102 stops its rotation. In addition, the drive gear 172 is supported to the apparatus main body by a shaft 107. If the drive source (not illustrated) stops transmitting the drive force, the drive gear 172 stops. In other words, the drive gear 172 cannot transmit or return the drive force to the drive source.

The shaft 107 of the drive gear 172 and the center of rotation of the rotary 102 are connected together by an arm 103. The arm 103 is rotatably supported by the shaft 107. In addition, the arm 103 is biased by an arm spring 104, which is fixed to the apparatus main body on one edge thereof. Accordingly, the arm 103 receives a rotational force for rotating around the shaft 107.

The rotary 102 integrally supports the development devices 18*a* through 18*d* to control the development rollers 182*a* through 182*d* of the development devices 18*a* through 18*d* to be positioned substantially on the circumference (i.e., substantially on the outer circumference) of the rotary 102. In addition, the rotary 102 is rotatably supported by the arm 103.

In addition, a rotatable disk 101 is provided to the rotary 102 to the front of the rotary 102 in FIG. 6. The rotatable disk 101 can rotate concentrically with the rotary 102. The rotatable disk 101 engages the rotary 102 at the rotational center of the rotatable disk 101. In the present exemplary embodiment, the rotary 102 and the rotatable disk 101 are provided as separate members. However, alternatively, the rotary 102 and the rotatable disk 101 can be integrally formed.

In addition, around the disk 101, a regulation roller 105 is provided, which is in contact with the disk 101 on the outer periphery of the disk 101. Coming in contact with the outer periphery of the disk 101, the regulation roller 105 is freely rotatably supported by a roller holder 106, which is provided to the apparatus main body.

In addition, the surface of the regulation roller 105 is constituted by an elastic rubber layer. Accordingly, the noise which may occur due to the contact between the regulation roller 105 and the outer periphery of the disk 101 can be reduced and the disk 101 can be securely rotated by due to the high coefficient of friction of the rubber layer.

In the present exemplary embodiment, the regulation roller 105 is freely rotatably supported by the roller holder 106. However, if the sliding property of the outer peripheral surface of the regulation roller 105 is high, it is neither necessary that the regulation roller 105 can rotate nor that a roller is used as the regulation roller 105. More specifically, in this case, any member that can securely guide the rotation of the disk 101 while keeping in contact with the outer periphery of the disk 101 without hindering the rotation of the disk 101.

The arm 103, which is biased by the arm spring 104, primarily biases the rotary 102 and applies a abutment pressure between the development roller 182*a* and the photosensitive drum 2. The disk 101 and the regulation roller 105 are configured to apply an appropriate abutment pressure between the development roller 182*a* and the photosensitive drum 2.

As described above, in causing the development rollers 182*a* through 182*d* to abut on and separate from the surface of the photosensitive drum 2, the present exemplary embodiment can cause the development rollers 182*a* through 182*d* to abut on and separate from the surface of the photosensitive drum 2 merely by the rotation of the rotary 102. In other words, in the present exemplary embodiment, the operation for causing the development rollers 182*a* through 182*d* to abut on and separate from the surface of the photosensitive drum 2 is executed from the tangential direction of the photosensitive drum 2.

Therefore, in the present exemplary embodiment, it is not required to move the entire the rotary 102 in the direction of diameter of the photosensitive drum 2. Accordingly, it is not necessary to provide a space for causing the development rollers 182*a* through 182*d* to abut on and separate from. As a result, the present exemplary embodiment can effectively achieve a small-size apparatus main body.

In addition, by rotating the rotary 102 to change the development devices 18*a* through 18*d*, the operation for causing the development roller 182*a* through 182*d* to abut on and separate from can be executed. Accordingly, it is necessary to provide neither a special configuration for the abutment and separation operation nor a drive source. Therefore, the costs for manufacturing the apparatus can be effectively reduced.

In addition, the present exemplary embodiment can execute the abutment and separation operation and the operation for changing between the development devices 18*a* through 18*d* at the same time. Accordingly, the development rollers 182*a* through 182*d* can be controlled to abut on and separate from the surface of the photosensitive drum 2 at a high speed. In addition, in the present exemplary embodiment, the pulse motor is used as the drive source (not illustrated) for the rotary 102 to freely control the rotation driving of the rotary 102.

Now, a mechanism of streak of the developer that may occur on the surface of a photosensitive drum will be described below.

The following problem may occur when a printing operation is executed on the image forming apparatus which executes the operation for causing the development rollers 182*a* through 182*d* to abut on and separate from the surface of the photosensitive drum 2 from the tangential direction of the photosensitive drum 2.

Specifically, when the development roller 182 abuts on or separates from the photosensitive drum 2, the developer on the development roller 182 may adhere to the surface of the photosensitive drum 2 in a streak shape. In the following description, the phenomenon will be referred to as "abutment/separation fogging".

If the abutment/separation fogging has occurred, the developer adhering to the surface of the photosensitive drum 2 in a streak shape may smear the intermediate transfer belt 7. In this case, the smear on the intermediate transfer belt 7 may be further transferred to the secondary transfer roller 82. As a result, a smear may occur on the back side of the sheet material S. As a result, image defect may occur.

The inventor of the present invention observed that the moving speed of the surface of the development roller 182 was far higher than the moving speed of the surface of the photosensitive drum 2 when the development roller 182 abutted on or separated from the photosensitive drum 2. In addition, the inventor of the present invention also observed that the difference in the moving speed of the surface of the development roller 182 and the moving speed of the surface of the photosensitive drum 2 affected the contact/separation fogging.

More specifically, the inventor of the present invention observed that to prevent abutment/separation fogging, it is necessary to secure a greater difference between the surface potential of the photosensitive drum 2 after the photosensitive drum 2 is charged and the surface potential of the development roller 182 as the relative speed of the surface of the development roller 182 with respect to the surface of the photosensitive drum 2 becomes higher.

In the following description, the difference between the surface potential of the photosensitive drum 2 after the photosensitive drum 2 is charged and the surface potential of the development roller 182 (first potential difference) will be referred to as a "first back contrast". On the other hand, the potential difference between the potential of the photosensitive drum 2 in the non-imaging portion thereof and the surface potential of the development roller 182 (second potential difference) during development, during which the latent image is formed on the photosensitive drum 2, will be hereafter referred to as a second back contrast.

Now, a result of an experiment will be described. The relative speeds of the surface of the photosensitive drum 2 and the surface of the development roller 182 during development abutment and separation will be described.

During the development of the latent image executed by the image forming apparatus according to the present exemplary embodiment, the moving speed of the surface of the photosensitive drum 2 was 100 mm/s, the moving speed of the surface of the development roller 182 was 160 mm/s, and the moving speed of the surface of the rotary 102 was 240 mm/s.

Therefore, when the rotary 102 stops at the development position, the relative speed of the surface of the development roller 182 with respect to the moving speed of the surface of the photosensitive drum 2 is 60 mm/s (=160−100 [mm/s]). On the other hand, during development abutment or development separation, while the development roller 182 is driven at the moving speed of 160 mm/s, the rotary 102 conveyed the development device 18 at the speed of 240 mm/s.

Therefore, during development abutment or development separation, the maximum relative speed of the surface of the development roller 182 in relation to the moving speed of the surface of the photosensitive drum 2 is 300 mm/s (160+240−100 [mm/s]). As a result, the relative speed of the surface of the development roller 182 with respect to the speed of the surface of the photosensitive drum 2 during development abutment or development separation is higher than the relative speed of the surface of the development roller 182 with respect to the speed of the surface of the photosensitive drum 2 at the development position when the rotary 102 is stopped and the latent image was developed.

Now, the relative speed of the surface of the development roller 182 and the amount of fogging will be described.

The inventor of the present invention conducted an experiment to study the correlation between the relative speed of the surface of the development roller 182 with respect to the speed of the surface of the photosensitive drum 2 and the amount of abutment/separation fogging. The detail will be described below.

To begin with, an experimental apparatus will be described. In the experiment, the experimental apparatus included a charge roller, a photosensitive drum, a cleaning device, and a development device similar to those of the image forming apparatus according to the present exemplary embodiment.

More specifically, as the experimental apparatus, an idle running apparatus was used, to which the charge roller, the photosensitive drum, the cleaning device, and the development device described above can be installed with the positional relationship among them similar to the positional relationship among the components when the charge roller, the photosensitive drum, the cleaning device, and the development device are installed on the image forming apparatus according to the present exemplary embodiment. The idle running apparatus was capable of independently and separately control the drive speed of each of the photosensitive drum and the development roller.

In addition, a high voltage power supply unit (Model 615-3, manufactured by TREK Japan KK) was used, which can apply a predetermined bias voltage to each of the charge roller, the development roller, the regulation blades, and the developer feed roller. Similar to those of the image forming apparatus according to the present exemplary embodiment, the level of the bias voltage applied to each of the development roller, the regulation blades, and the developer feed roller was kept at the same even level.

The above-described experimental apparatus was used in the experiment. In the experiment, similar to the image forming apparatus, the entire apparatus was shielded from light to prevent the external light from irradiating the photosensitive drum. The experiment was performed in the following operations 1 thorough 5:

1. The charge roller, the photosensitive drum, the cleaning device, and the development device were installed on the above-described experiment apparatus. Subsequently, while applying the bias voltage for achieving the surface potential of the photosensitive drum of −500 V to the charge roller, the idle running was conducted by controlling the moving speed of the surface of the photosensitive drum at 50 mm/s and the moving speed of the surface of the development roller at 100 mm/s. At this time, the relative speed of the surface of the development roller with respect to the surface of the photosensitive drum was 50 mm/s.

2. Subsequently, in the above-described state, the bias voltage was applied to the development roller, the regulation blades, and the developer feed roller to achieve the predetermined value of the surface potential of the development roller. Subsequently, the rotation of the photosensitive drum and the development roller was stopped after the photosensitive drum had rotated by at least one revolution. Then, the bias voltage that had been applied to the charge roller, the development roller, the regulation blades, and the developer feed roller was shut off.

3. After peeling off the developer that had adhered to the surface of the photosensitive drum after moving past the development position by a colorless transparent polyester tape, the peeled developer was affixed on a white paper. Then, the level of whiteness of the developer on the polyester tape was measured by a whiteness photometer (TC-6D, manufactured by Tokyo Denshoku KK). Then the difference between the measured whiteness and the whiteness of the polyester tape, to which no developer had adhered, affixed on a white paper was calculated. The calculated difference was quantified as the amount of fogging.

4. While changing the level of the bias voltage applied to the development roller, the regulation blades, and the developer feed roller, the operations 1 through 3 were conducted several times. Subsequently, the correlation between the back contrast and the amount of fogging was examined within the range of back contrast of 30 V to 370 V.

5. After examining the correlation at the above-described development drive speed, the moving speed of the surface of the development roller was changed to 100 mm/s and to 150 mm/s and then the similar experiment was conducted to examine the affect on the correlation between the back contrast and the amount of fogging from the relative speed of the surface of the development roller with respect to the surface of the photosensitive drum.

Figure 7:
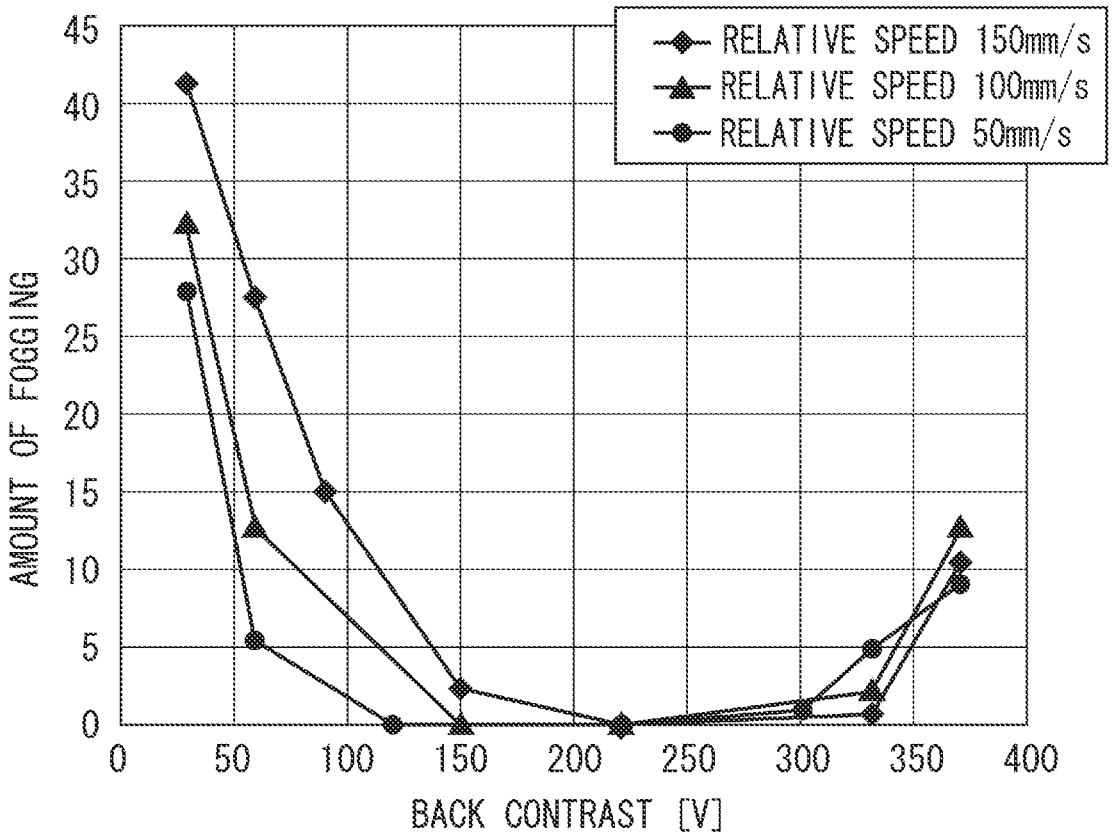
FIG. 7 illustrates an exemplary relationship between a back contrast and the amount of fogging.

Now, the results of the experiment will be described in detail below. FIG. 7 is a graph which illustrates results of the experiment described above. In the example illustrated in FIG. 7, the back contrast is taken on the horizontal axis while the amount of fogging is taken on the vertical axis.

A circular plot indicates an experimental result acquired when the relative speed of the surface of the development roller with respect to the surface of the photosensitive drum was 50 mm/s. A triangular plot indicates an experimental result acquired when the relative speed of the surface of the development roller with respect to the surface of the photosensitive drum was 100 mm/s. A diamond-shaped plot indicates an experimental result acquired when the relative speed of the surface of the development roller with respect to the surface of the photosensitive drum was 150 mm/s.

The inventor of the present invention observed that the amount of fogging decreased as the back contrast was increased from 30 V at all development drive speeds. In this case, it was observed that the amount of fogging at the same back contrast increased as the relative speed of the surface of the development roller with respect to the surface of the photosensitive drum became higher.

The result suggests that to control the amount of fogging equal to or less than the predetermined value, it is necessary to secure a higher back contrast as the relative speed of the surface of the development roller with respect to the surface of the photosensitive drum becomes higher.

Subsequently, when the back contrast was further increased, the amount of fogging showed a tendency to further increase but at this stage of the experiment, no correlation between relative speed of the surface of the development roller with respect to the surface of the photosensitive drum was observed.

According to the above-described experimental result, the inventor of the present invention found that the rise of relative speed of the surface of the development roller with respect to the surface of the photosensitive drum, which occurs during the development abutment and separation, affected the abutment/separation fogging.

In addition, the inventor of the present invention also found that to prevent the abutment/separation fogging, it is useful to increase the back contrast to a value higher than the value at the development timing when the development roller 182 abuts on or separates from the photosensitive drum 2.

Figure 8:
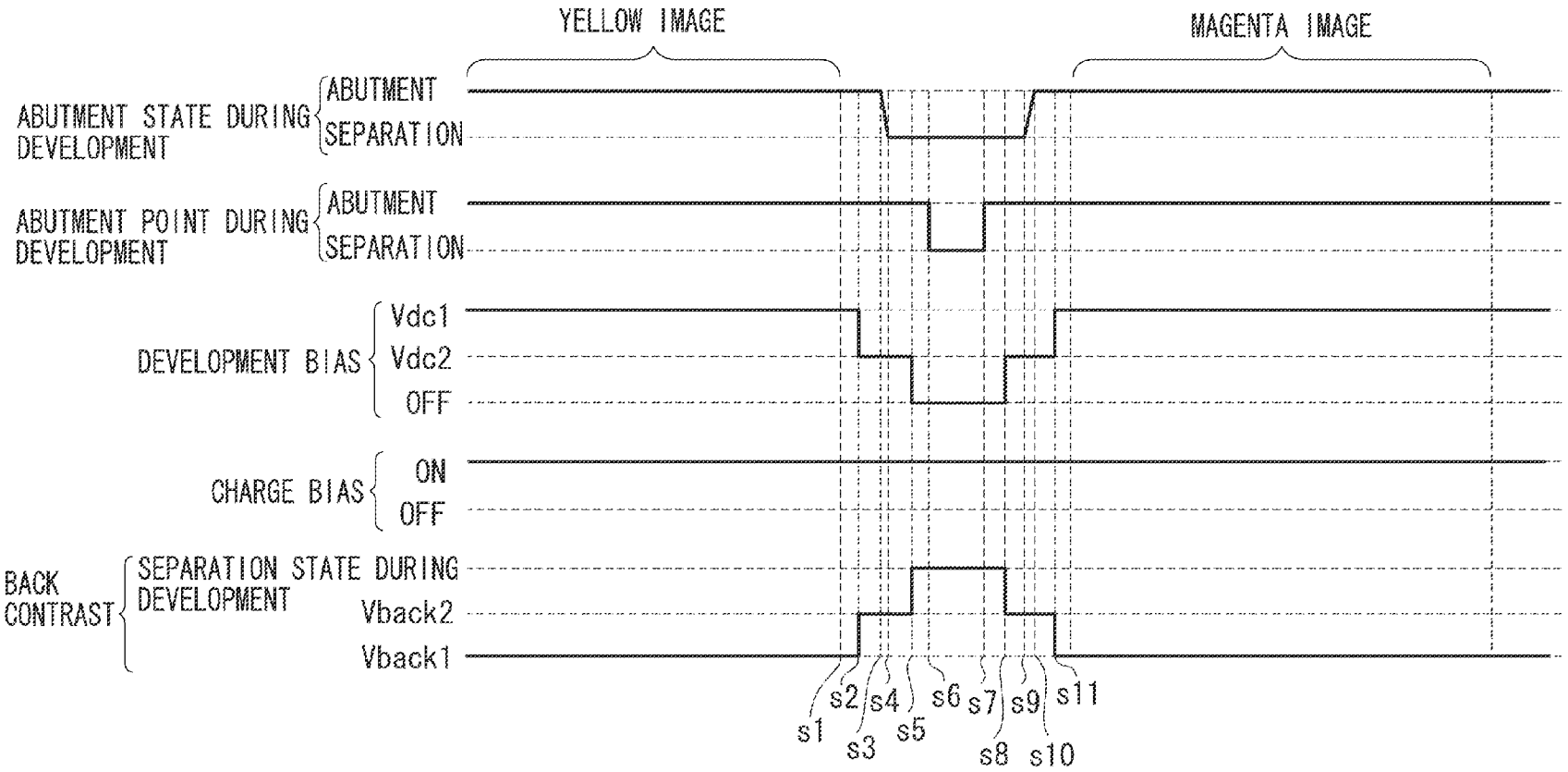
FIG. 8 is a timing chart which illustrates timings of development abutment and separation according to the first exemplary embodiment of the present invention.

Now, according to the above-described experimental results, a sequence for preventing the abutment/separation fogging will be described below with reference to FIG. 8. FIG. 8 is a timing chart which illustrates timings of development abutment and separation on the image forming apparatus according to the present exemplary embodiment.

In the example illustrated in FIG. 8, a sequence for the following operation is illustrated. Specifically, the rotary 102 rotates by substantially one-quarter revolution in the direction indicated by an arrow B (FIG. 3) from a state in which the development device 18*a* (yellow) is executing the development process at the development position. Subsequently, the development device 18*b* (magenta) completes the development process.

During the development process (i.e., during a time period before a timing s1), the development device 18*a* exists at the development position and the development bias voltage of −350V (Vdc1) is applied to the development roller 182*a*. Furthermore, the charge bias voltage of −1,050 V is applied to charge roller 3 for achieving the photosensitive drum surface potential of −500 V. Furthermore, the back contrast of 150 V (Vback1), which is appropriate for the development process, is set.

After the yellow development device 18*a* has completed the development process at the timing s1, the control device 9 changes the development bias voltage to −200 V (Vdc2) at a timing s2 to secure aback contrast higher than the back contrast achieved during the development process to prevent the abutment/separation fogging. At the timing s2, the back contrast is changed from 150 V (Vback1) to 300 V (Vback2).

Subsequently, the control device 9 starts the operation for separating the development device 18*a* by the rotation of the rotary 102 at a timing s3. At a timing s4, the development roller 182*a* separates from the photosensitive drum 2. At a timing s5, the development bias voltage is shut off. Furthermore, at a timing s6, the electric contacts of the image forming apparatus main body and the development device 18*a* are separated from each other. Subsequently, at a timing s7, the image forming apparatus main body abut on the electric contacts of the development device 18*b* (magenta) to achieve the conducting state between the image forming apparatus and the development device 18*b* (magenta).

At a timing s8, the development bias voltage of −200 V (Vdc2) is applied to the development device 18*b* to achieve the back contrast of 300 V (Vback2), which is appropriate for preventing the abutment/separation fogging. Subsequently, the control device 9 executes control of the development roller 182*b* and the photosensitive drum 2 to be ready for the mutual abutment, which is executed at a timing s9.

If the electric contacts of the image forming apparatus main body and the development device 18 abut on or separate from each other when the development bias voltage has been applied, electric noise may be generated due to discharge. If the electric noise occurs, there may be a threat of causing the image forming apparatus to malfunction or a threat of damaging the electric contacts, which may occur due to spark discharge. Accordingly, the electric contacts are to abut on or separate from each other when the development bias voltage has been shut off.

Subsequently, when the development device 18*b* reaches the development position and the development roller 182B has completed abutment on the photosensitive drum at a timing s10, the control device 9 changes the development bias voltage from −200 V (Vdc2) to −350 V (Vdc1) at a timing s11 to prepare for the start of the development process by the development device 18*b*. In this state, the back contrast of 150 V (Vback1), which is appropriate for the development process, is achieved.

The above-described operations are applied at the timing of the development abutment of the development device 18*a* (yellow), at the timing of the changing from the development device 18*b* (magenta) to the development device 18*c* (cyan), at the timing of the changing from the development device 18*c* (cyan) to the development device 18*d* (black), and the development separation of the development device 18*d* (black).

The image forming executed in the above-described manner, so that neither abutment/separation fogging nor a smear on the back side of the sheet material occurred.

In the present exemplary embodiment, the development abutment and the development separation are executed as the operations during the development process. However, the above-described sequence for preventing the abutment/separation fogging can be applied at any other timings of the development abutment and development separation.

For example, the above-described sequence can apply if the development device 18 moves past the photosensitive drum 2 without temporarily stopping at the position opposing the photosensitive drum 2 in addition to the case where the development device 18 temporarily stops at a position opposing the photosensitive drum 2 as in the development process.

Now, an image forming apparatus according to a second exemplary embodiment of the present invention will be described below. The image forming apparatus according to the present exemplary embodiment and the image forming apparatus according to the above-described first exemplary embodiment differs by the sequence for preventing the abutment/separation fogging only. The configuration of the image forming apparatus, the configuration of the development devices, the method for transmitting the drive force to the developer bearing member, and the configuration of the development device supporting member is similar to the first exemplary embodiment. Therefore, the description is omitted and the sequence for preventing the abutment/separation fogging only will be described below.

Figure 9:
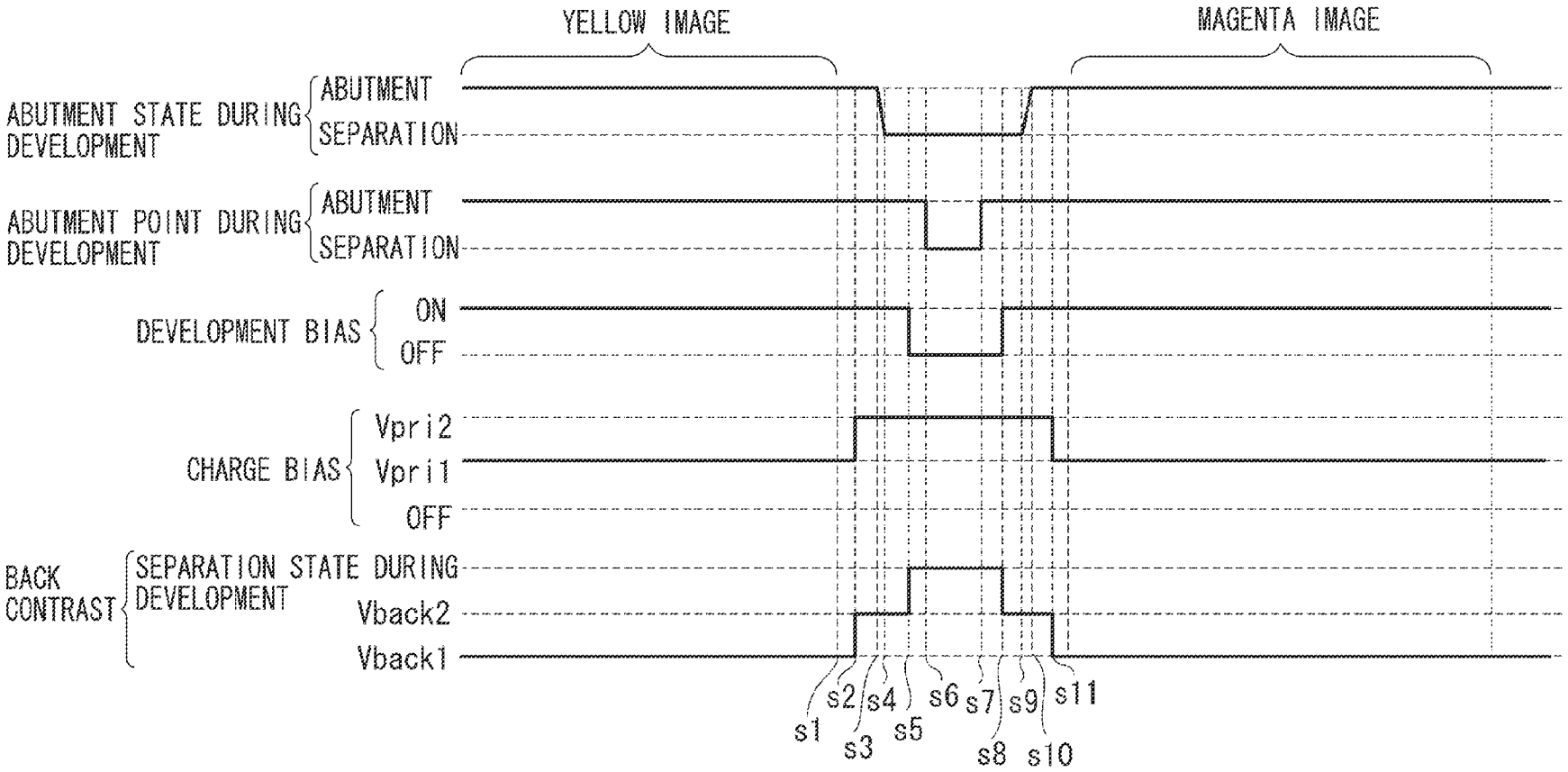
FIG. 9 is a timing chart which illustrates timings of development abutment and separation according to a second exemplary embodiment of the present invention.

FIG. 9 is a timing chart, which illustrates timings of development abutment and separation on the image forming apparatus according to the present exemplary embodiment. In the example illustrated in FIG. 9, a sequence for the following operation is illustrated. More specifically, in the timing chart illustrated in FIG. 9, the rotary 102 rotates by substantially one-quarter revolution in the direction indicated by an arrow B (FIG. 3) from a state in which the development device 18*a* (yellow) is executing the development process at the development position. Subsequently, the development device 18*b* (magenta) completes the development process.

During the development process (i.e., during a time period before a timing s1), the development device 18*a* exists at the development position and the development bias voltage of −350 V is applied to the development roller 182*a*. Furthermore, the charge bias voltage of −1,050 V (Vpri1) is applied to achieve the photosensitive drum surface potential of −500 V. Furthermore, the back contrast of 150 V (Vback1), which is appropriate for the development process, is set.

The yellow development device 18*a* completes the development process at the timing s1. Subsequently, at a timing s2, the control device 9 changes the charge bias voltage to −1,200 V (Vpri2) to control the surface potential of the photosensitive drum 2 at −650 V. Accordingly, the present exemplary embodiment can secure aback contrast higher than that during the development process to effectively prevent the abutment/separation fogging. At this timing, the back contrast is changed from 150 V (Vback1) to 300 V (Vback2).

Subsequently, the control device 9 starts the operation for separating the development device 18*a* by the rotation of the rotary 102 at a timing s3. At a timing s4, the development roller 182*a* separates from the photosensitive drum 2. At a timing s5, the development bias voltage is shut off. Furthermore, at a timing s6, the electric contacts of the image forming apparatus main body and the development device 18*a* are separated from each other. Subsequently, at a timing s7, the image forming apparatus body abuts on the electric contacts of the development device 18*b* (magenta) to achieve the conducting state between the image forming apparatus and the development device 18*b* (magenta).

Subsequently, at a timing s8, the control device 9 executes control for applying the development bias voltage of −350 V to the magenta development device 18*b*. Subsequently, the control device 9 executes control of the development roller 182B and the photosensitive drum 2 to be ready for the mutual abutment, which is executed at a timing s9. In this case the charge bias voltage of −1200V (Vpri2) remains to be applied.

Subsequently, when the development device 18*b* reaches the development position and the development roller 182*b* has abutted on the photosensitive drum completely at a timing s10, the control device 9 changes the development bias voltage from −1,200 V (Vpri2) to −1,050V (Vpri1) at a timing s11 to prepare for the start of the development process by the development device 18*b*.

At this timing, the potential of the surface of the photosensitive drum 2 has been changed from −650 V to −500 V. In addition, the back contrast has been changed from 300 V (Vback2) to 150 V (Vback1), which is appropriate for the development process.

The above-described operations are applied at the timing of the development contact of the development device 18*a* (yellow), at the timing of the changing from the development device 18*b* (magenta) to the development device 18*c* (cyan), at the timing of the changing from the development device 18*c* (cyan) to the development device 18*d* (black), and the development separation of the development device 18*d* (black).

The image forming executed in the above-described manner, so that neither abutment/separation fogging nor a smear on the back side of the sheet material occurred.

In the present exemplary embodiment, the development abutment and the development separation are executed as the operations during the development process. However, the above-described sequence for preventing the abutment/separation fogging can be applied at any other timings of the development contact and development separation.

For example, the above-described sequence can apply if the development device 18 moves past the photosensitive drum 2 without temporarily stopping at the position opposing the photosensitive drum 2 in addition to the case where the development device 18 temporarily stops at a position opposing the photosensitive drum 2 as in the development process.

In the present exemplary embodiment, to prevent the abutment/separation fogging, the back contrast is increased by changing the charge bias voltage during the development abutment and the development separation. However, the method or unit for increasing the back contrast is not limited to those described above. In addition, the method or unit is not limited to a function for changing the charge bias voltage.

Now, an image forming apparatus according to a third exemplary embodiment of the present invention will be described in detail below. The image forming apparatuses according to the present exemplary embodiment and the first exemplary embodiment differ from each other in two points, i.e., the configuration of the development device supporting member and the sequence for preventing the abutment/separation fogging.

The configuration of the development device supporting member is different from the configuration of the development device supporting member according to the first and the second exemplary embodiments described above. Specifically, during either one of the abutment and the separation, the rotary 102 moves in the tangential direction with respect to the photosensitive drum 2. During the other operation, the rotary 102 moves in the normal direction with respect to the photosensitive drum 2.

The image forming apparatus, the development devices, and the method of transmitting the drive force to the developer bearing member are similar to that in the first exemplary embodiment. Therefore, the description will be omitted.

Now, exemplary configurations of the rotary 102 (developer bearing member) according to the present exemplary embodiment and peripheral members thereof will be described below with reference to FIGS. 10 and 11.

Figure 10:
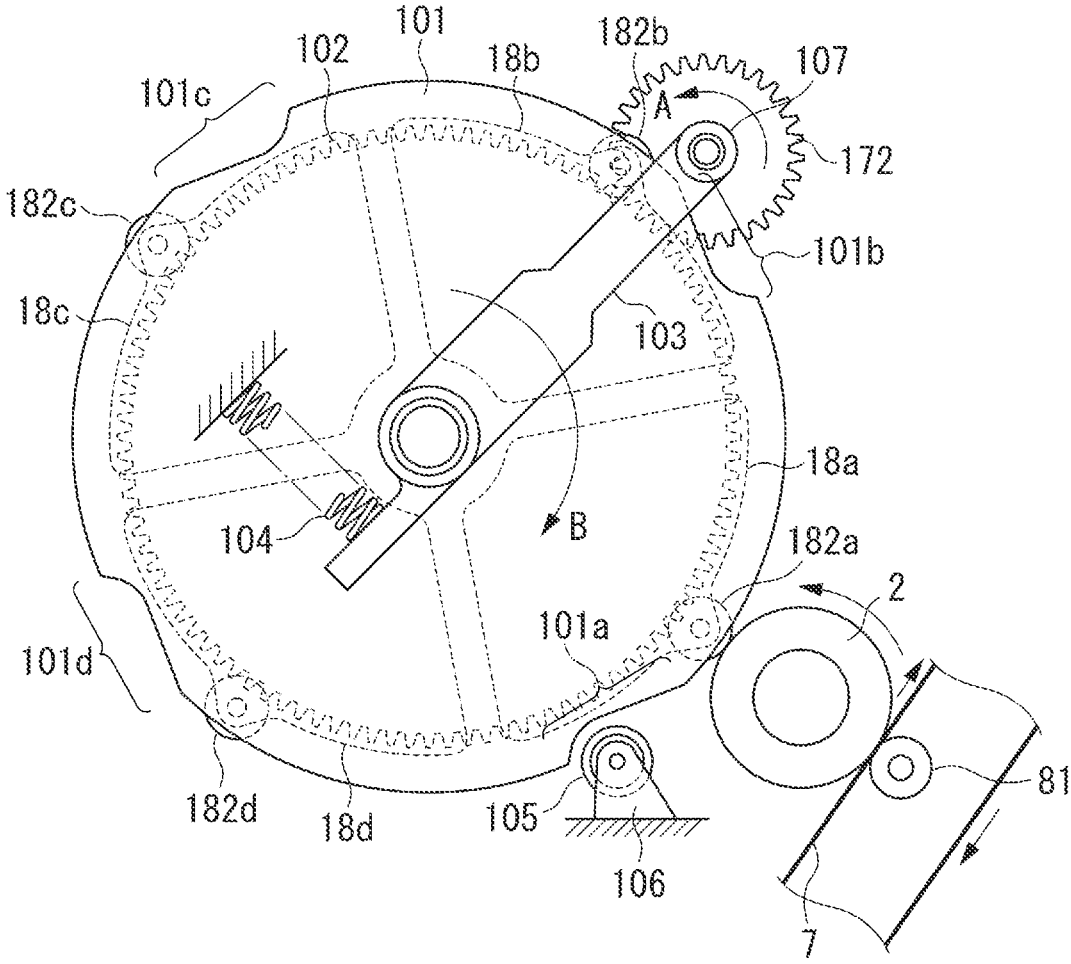
FIG. 10 illustrates an exemplary configuration of a rotary and a peripheral member thereof according to a third exemplary embodiment of the present invention.
Figure 11:
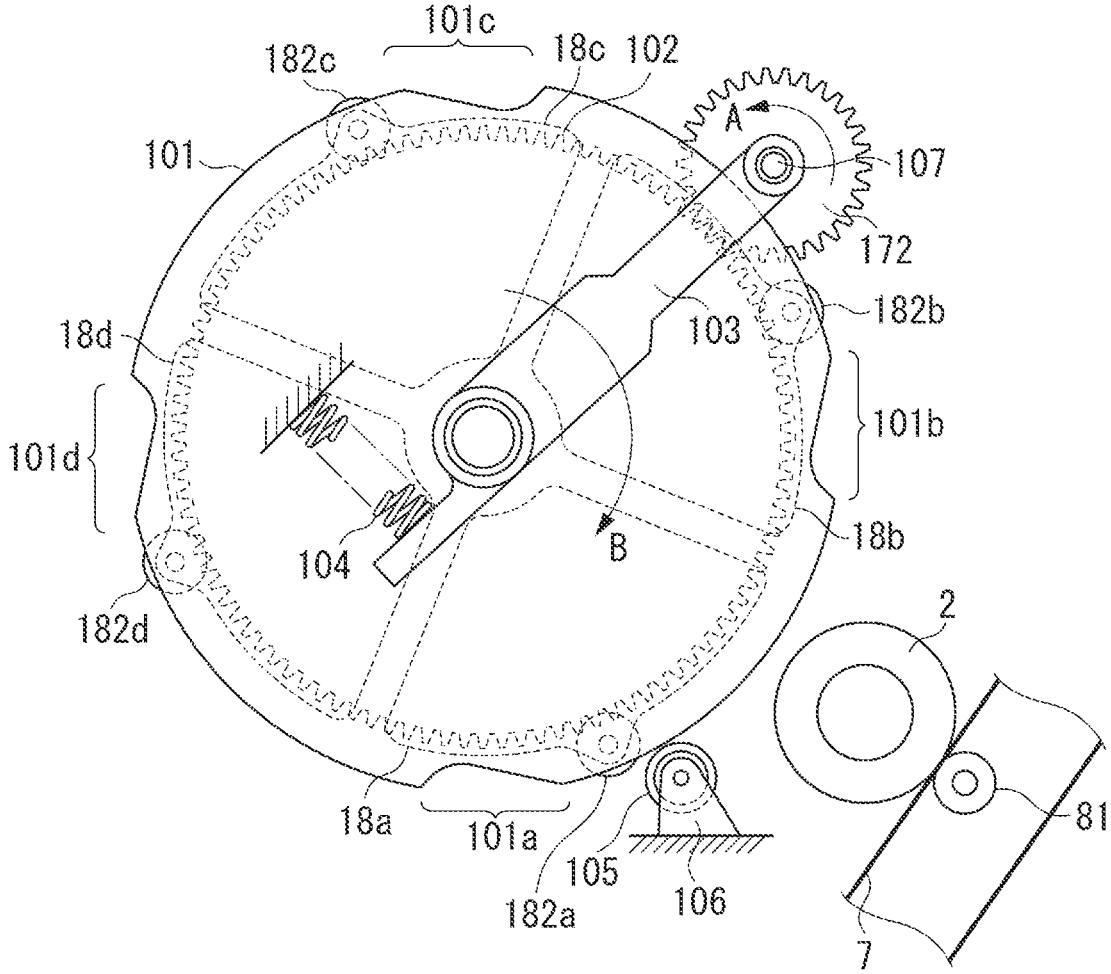
FIG. 11 illustrates an exemplary configuration of a rotary and a peripheral member thereof according to the third exemplary embodiment of the present invention.

In the example illustrated in FIG. 10, the development roller 182*a*, which is rotatably supported by the development device 18*a*, is currently developing the electrostatic latent image formed on the photosensitive drum 2 (i.e., the development roller 182*a* is in a state of abutment on the photosensitive drum 2). In the example illustrated in FIG. 11, a state in which the development device is being changed from the development device 18*a* to the development device 18*b* due to the rotation of the rotary 102 is illustrated.

The rotary 102, which is a rotatable member having a substantially circular shape, has gear teeth formed on its outer periphery. The gear teeth engage a drive gear 172.

More specifically, the drive force is transmitted from the drive source (not illustrated) to the drive gear 172 to rotate the rotary 102. When the drive gear 172 is rotated in a direction A in FIG. 10, the rotary 102 is rotated in a direction B in FIG. 10. When the drive gear 172 stops, the rotary 102 stops its rotation. In addition, the drive gear 172 is supported in the apparatus body by the shaft 107. If the drive source (not illustrated) stops transmitting the drive force, the drive gear 172 stops. In other words, the drive gear 172 cannot transmit or return the drive force to the drive source.

The shaft 107 of the drive gear 172 and the center of rotation of the rotary 102 are connected together by the arm 103. The arm 103 is rotatably supported by the shaft 107. In addition, the arm 103 is biased by the arm spring 104, which is fixed to the apparatus main body on one edge thereof. Accordingly, the arm 103 receives a rotational force for rotating around the shaft 107.

The rotary 102 integrally supports the development devices 18*a* through 18*d* to control the development rollers 182*a* through 182*d* of the development devices 18*a* through 18*d* to be positioned substantially on the circumference (i.e., substantially on the outer circumference) of the rotary 102. In addition, the rotary 102 is rotatably supported by the arm 103.

In addition, a rotatable disk 101 is provided to the rotary 102 to the front of the rotary 102 in FIG. 10. The rotatable disk 101 includes recessed portions 101*a* through 101*d*, which have the same shape and which are provided at substantially equal intervals at the outer periphery of the disk 101. The rotatable disk 101 engages the rotary 102 at the rotational center of the rotatable disk 101. In other words, the disk 101 and the rotary 102 are configured to move always in synchronization with each other.

In the present exemplary embodiment, the rotary 102 and the rotatable disk 101 are provided as separate members. However, alternatively, the rotary 102 and the rotatable disk 101 can be integrally formed.

In addition, around the disk 101, the regulation roller 105 is provided, which is in contact with the disk 101 on the outer periphery of the disk 101. Coming in contact with the outer periphery of the disk 101, the regulation roller 105 is freely rotatably supported by the roller holder 106, which is provided to the apparatus body.

In addition, the surface of the regulation roller 105 is constituted by an elastic rubber layer. Accordingly, the noise which may occur due to the contact between the regulation roller 105 and the outer periphery of disk 101 can be reduced and the disk 101 can be securely rotated owing to the high coefficient of friction of the rubber layer.

In the present exemplary embodiment, the regulation roller 105 is freely rotatably supported by the roller holder 106. However, if the sliding property of the outer peripheral surface of the regulation roller 105 is high, it is neither necessary that the regulation roller 105 can rotate nor that a roller is used as the regulation roller 105. More specifically, in this case, any member that can securely guide the rotation of the disk 101 while keeping in contact with the outer periphery of the disk 101 without hindering the rotation of the disk 101.

Referring to FIG. 10, the regulation roller 105 is provided around the recessed portions 101*a* through 101*d*, which are provided to the disk 101. The recessed portions 101*a* through 101*d* are provided on the outer periphery of the disk 101 to prevent a contact between the regulation roller 105 and the disk 101.

Therefore, the arm 103, which is biased by the arm spring 104, primarily bias the rotary 102. As a result, the biasing force from the arm 103 becomes the abutment pressure between the development rollers 182*a* through 182*d* and the photosensitive drum 2.

As described above with reference to FIG. 3, the development roller 182*a* abuts on the surface of the photosensitive drum 2 by the bias of the arm spring 104 with the appropriate abutment pressure. When the rotary 102 is rotated, the abutment between the development roller 182*a* and the photosensitive drum 2 is released (state as illustrated in FIG. 11).

To paraphrase this, during the development, the rotary 102 stops. However, when the development ends, the rotary 102 resumes its rotation. In this state, the development roller 182*a* separates from the surface of the photosensitive drum 2. When the development roller 182*a* is separated from the surface of the photosensitive drum 2, the disk 101 abuts on the regulation roller 105.

The outer periphery of the disk 101 except the recessed portions 101*a* through 101*d* is formed with the configuration for preventing the development devices 18*a* through 18*d* from contacting the photosensitive drum 2 while the disk 101 abuts on the regulation roller 105. Accordingly, without affecting the photosensitive drum 2, the control device 9 can control the development devices 18*a* through 18*d* to sequentially move to the development position. In addition, the control device 9 can control the development rollers 182*a* through 182*d* to sequentially contact the surface of the photosensitive drum 2.

More specifically, when the development device 18*b* (~18*d*) is moved to the development position, a controller (not illustrated) cuts off the drive force to the drive gear 172. In addition, the recessed portion 101*b* (~10*d*) of the disk 101 moves to a position around the regulation roller 105.

Accordingly, the control device 9 can control the development rollers 182*b* (~182*d*) to abut on the photosensitive drum 2 at the predetermined pressure. In the above-described manner, the control device 9 executes control for sequentially developing the electrostatic latent images by the development devices 18*a* through 18*d*.

As described above, in controlling the development rollers 182*a* through 182*d* to sequentially abut on or separate from the surface of the photosensitive drum 2, the present exemplary embodiment can implement the abutment and the separation between the development rollers 182*a* through 182*d* and the surface of the photosensitive drum 2 merely by the rotation of the rotary 102. In other words, in the present exemplary embodiment, the operation for abutting on or separating from the surface of the photosensitive drum 2 can be executed also in the substantially normal direction of the photosensitive drum 2 at the development position as well as from the tangential direction of the photosensitive drum 2 at the development position.

In the present exemplary embodiment, the greater of components of the relative speed of the development roller 182 to the photosensitive drum 2 during the contact or the separation is described as "abutment/separation in the tangential direction". On the other hand, the smaller of components of the relative speed of the development roller 182 to the photosensitive drum 2 during the abutment or the separation, compared with the "abutment/separation in the tangential direction", is described as "abutment/separation in the normal direction".

Accordingly, the component of the relative speed of the development roller 182 in the tangential direction to the photosensitive drum 2 during the development abutment/separation in the image forming apparatus according to the present exemplary embodiment may have a value smaller than the value of the corresponding component in the image forming apparatuses according to the first and the second exemplary embodiments. However, in the image forming apparatus according to the present exemplary embodiment, the development separation operation is executed in the antigravitational direction.

Accordingly, to reduce the drive torque of the rotary as much as possible, the recessed portions 101*a* through 101*d* of the disk 101 have the shape of an arch that is looser during the separation than during the abutment. Therefore, the components of the relative speed of the development roller 182 with respect to the surface of the photosensitive drum 2 in the tangential direction of the photosensitive drum 2 during the development separation is greater than that during the development abutment.

Figure 12:
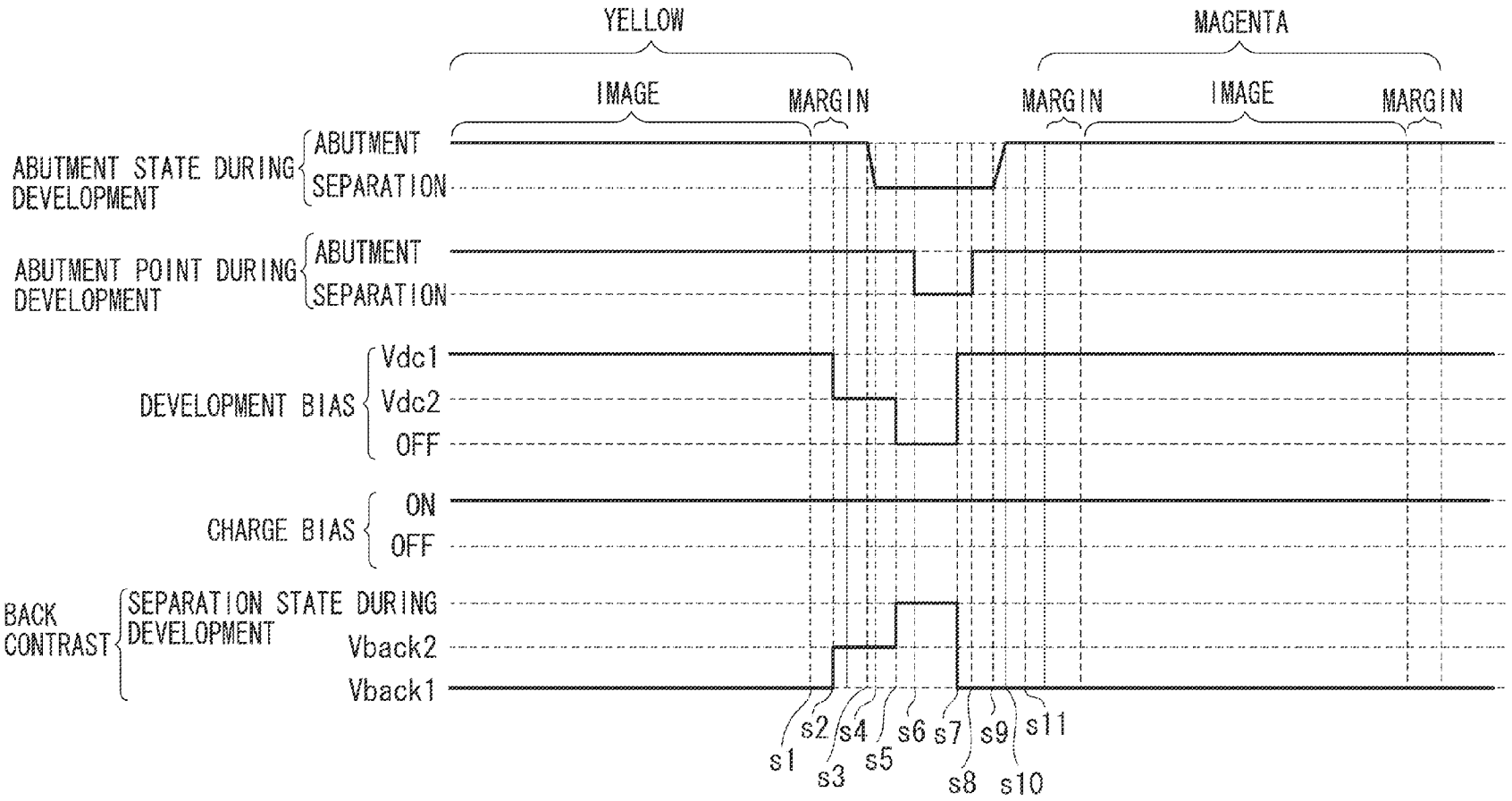
FIG. 12 is a timing chart which illustrates timings of development abutment and separation according to the third exemplary embodiment of the present invention.
Figure 13:
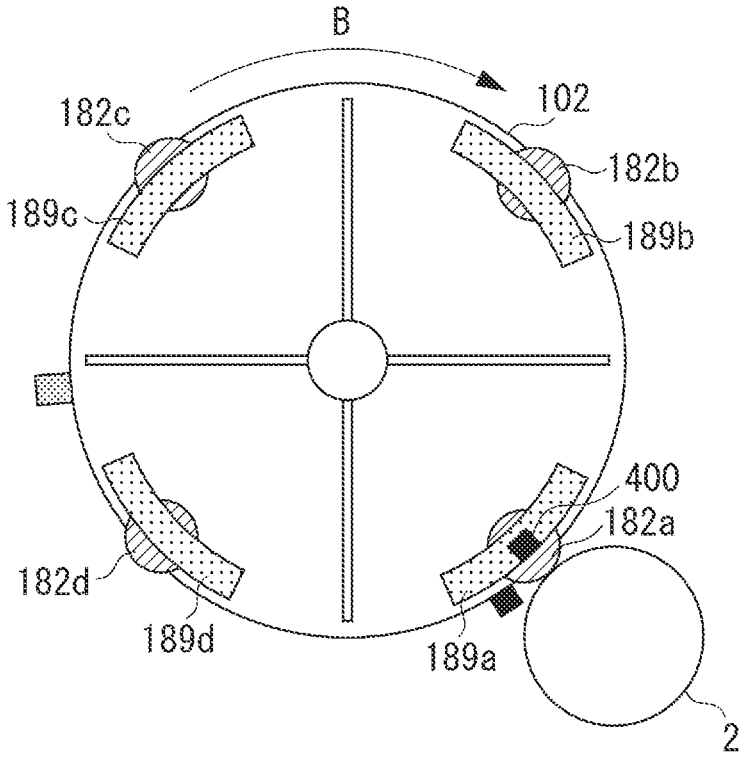
FIG. 13 illustrates an example of a relationship between an electric contact of an image forming apparatus main body that supplies power to the development device and an electric contact of the development device.

Now, a sequence for preventing the abutment/separation fogging according to the present exemplary embodiment will be described. FIG. 12 is a timing chart which illustrates timings of development abutment/separation on the image forming apparatus according to the present exemplary embodiment.

In the example illustrated in FIG. 12, a sequence for the following operation is illustrated. In the timing chart illustrated in FIG. 12, the rotary 102 rotates by substantially one-quarter revolution in the direction indicated by an arrow B (FIG. 3) from a state in which the development device 18*a* (yellow) is executing the development process at the development position. Subsequently, the development device 18*b* (magenta) completes the development process.

During the development process (~s2), the development device 18*a* exists at the development position and the development bias voltage of −350 V (Vdc1) is applied to the development roller 182*a*. Furthermore, the charge bias voltage of −1,050 V is applied to achieve the photosensitive drum surface potential of −500 V. In this case, the back contrast of 150 V (Vback1), which is appropriate for the development process, is set.

After the development device 18*a* (yellow) has completed the development process at the timing s1, the control device 9 changes the development bias voltage to −200 V (Vdc2) (s2) while the development roller 182*a* is conveying the sheet at a margin on the trailing edge of the sheet. In this manner, the present exemplary embodiment can secure a back contrast higher than the back contrast achieved during the development process on image regions to prevent the abutment/separation fogging. At this timing, the back contrast is changed from 150 V (Vback1) to 300 V (Vback2).

By changing the development bias voltage while the development roller 182*a* is conveying the sheet at a margin on the trailing edge of the sheet, the present exemplary embodiment can very quickly change the back contrast to the level high enough for preventing the abutment/separation fogging. Therefore, the present exemplary embodiment can start the rotation of the rotary 102 at an earlier timing.

Subsequently, the control device 9 starts the operation for separating the development device 18*a* by the rotation of the rotary 102 at a timing s3. At a timing s4, the development roller 182*a* separates from the photosensitive drum 2. At a timing s5, the development bias voltage is shut off. Furthermore, at a timing s6, the electric contacts of the image forming apparatus body and the development device 18*a* are separated from each other. Subsequently, at a timing s7, the electric contacts of the image forming apparatus body abuts on the development device 18*b* to achieve the conducting state between the image forming apparatus and the development device 18*b*. At a timing s8, the voltage of −350 V (Vdc1) is applied to the development device 18*b* to prepare for the abutment between the development roller 182*b* and the photosensitive drum 2, which is executed at a timing s9.

In the image forming apparatus according to the present exemplary embodiment, the development roller 182 contacts the photosensitive drum 2 from the substantially normal direction. Therefore, the relative speed of the development roller 182 with respect to the moving speed of the surface of the photosensitive drum 2 becomes substantially the same as the value during the development process.

Accordingly, during the development abutment, the present exemplary embodiment applies the voltage appropriate for the development process (Vdc1) without applying the development bias voltage (Vdc2) for preventing the abutment/separation fogging from the state in which the development bias voltage has been shut off. Subsequently, after the development device 18*b* has reached the development position, the control device 9 prepares for the start of the development process.

The above-described operations are applied at the timing of the development contact of the development device 18*a* (yellow), at the timing of the changing from the development device 18*b* (magenta) to the development device 18*c* (cyan), at the timing of the changing from the development device 18*c* (cyan) to the development device 18*d* (black), and the development separation of the development device 18*d* (black).

In the experiment conducted by the inventor, during image forming executed in the above-described manner, neither abutment/separation fogging nor a smear on the back side of the sheet material occurred.

In the present exemplary embodiment, the development abutment/separation are executed as the operations during the development process. However, the above-described sequence for preventing the abutment/separation fogging can be applied at any other timings of the development abutment/separation.

However, because the development abutment/separation are executed at substantially the same timing if the development device 18 moves without stopping at the position opposing the photosensitive drum 2, it is difficult not to execute the operation only in the development abutment. Accordingly, in this case, it is necessary to increase the back contrast while the development device passes the development position.

In the present exemplary embodiment, a back contrast set when the rotary 102 is moved in the substantially normal direction (a first movement) (the back contrast at this timing is a third potential difference) is different from a back contrast set when the rotary 102 is moved in the tangential direction (a second movement) (the back contrast at this timing is a fourth potential difference). In other words, if relative speed of the surface moving speed of the development roller with respect to the surface moving speed of the photosensitive drum becomes higher in the development abutment (or the separation) than in the development separation (or the abutment), the present exemplary embodiment increases the back contrast.

In the present exemplary embodiment, the rotary 102 and the development roller rotate in the same direction. Accordingly, when the rotary 102 moves in the tangential direction, the relative speed of the surface moving speed of the development roller with respect to the surface moving speed of the photosensitive drum becomes high. On the other hand, if the rotary 102 and the development roller rotate in the reverse directions, the relative speed of the surface moving speed of the development roller in relation to the surface moving speed of the photosensitive drum becomes low when the rotary 102 moves in the tangential direction.

In this case also, the present exemplary embodiment increases the back contrast if the relative speed of the surface moving speed of the development roller with respect to the surface moving speed of the photosensitive drum becomes high. In the above-described manner, the present exemplary embodiment can optimize the back contrast during the abutment and the separation.

In the present exemplary embodiment, the rotary 102 abuts on the photosensitive drum 2 in the substantially normal direction and separates from the photosensitive drum 2 in the tangential direction. However, the present invention can be applied to a case if the rotary 102 abuts on the photosensitive drum 2 in the tangential direction and separates from the photosensitive drum 2 in the normal direction.

With the above-described configuration, according to the present exemplary embodiment, the image forming apparatus of the present invention, which employs the rotary method, can achieve an image with a high image quality. In addition, the present invention can provide an image forming apparatus that can achieve downsizing of the apparatus main body and reduction of a cost.

Now, an image forming apparatus according to a fourth exemplary embodiment will be described.

Figure 15:
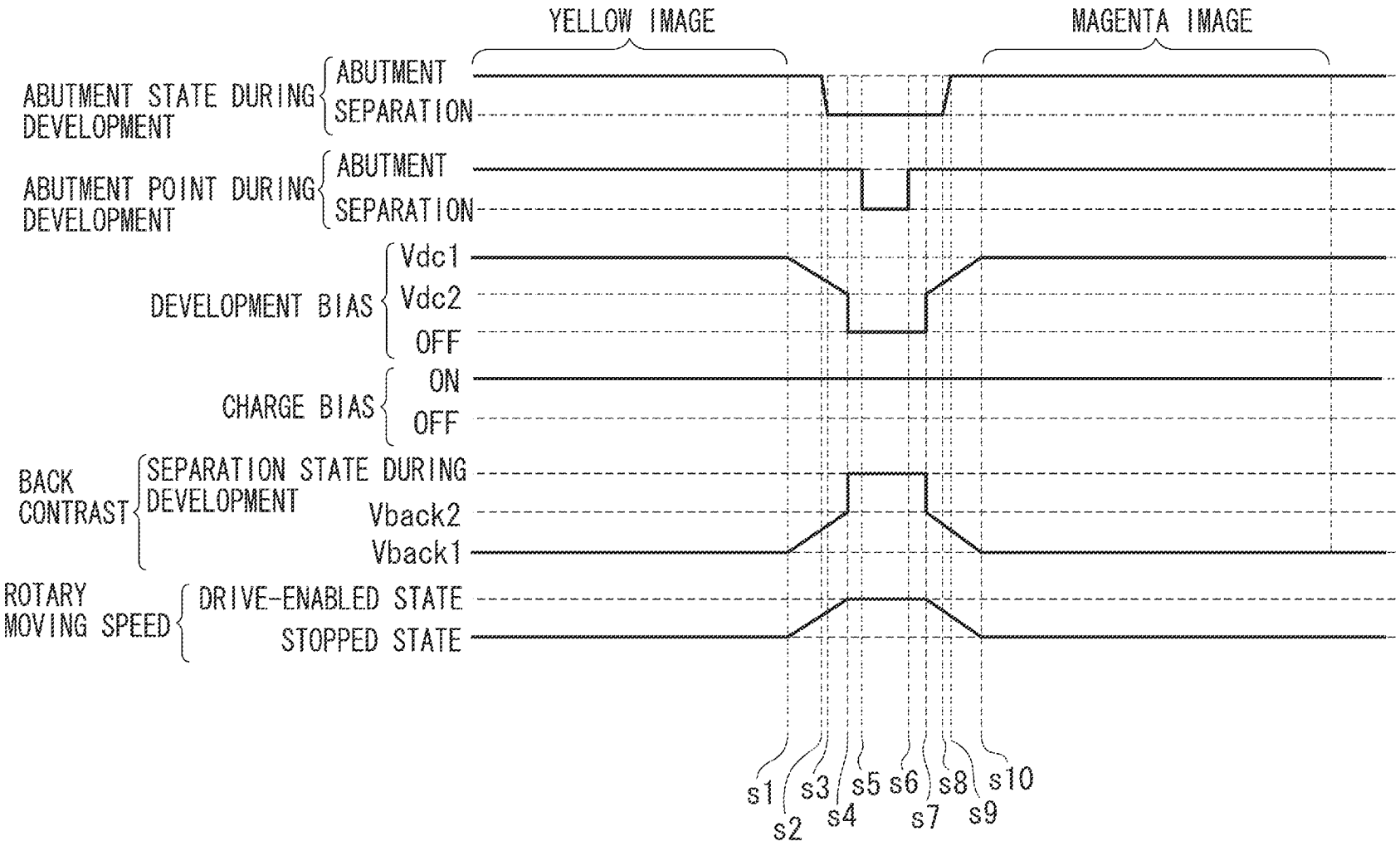
FIG. 15 is a timing chart which illustrates timings of development abutment and separation according to a fourth exemplary embodiment of the present invention.

FIG. 15 is a timing chart which illustrates timings for gradually changing the back contrast according to the variation of moving speeds of the rotary (rise or decay). The image forming apparatus according to the present exemplary embodiment is different from the image forming apparatus according to the first exemplary embodiment in the following two points. Specifically, it takes time for raising the moving speed of the rotary 102 to the target speed of 240 mm/s. In addition, in the present exemplary embodiment, the sequence for preventing the abutment/separation fogging is different from that in the above-described first exemplary embodiment.

In the example illustrated in FIG. 15, a sequence for the following operation is illustrated. In the timing chart illustrated in FIG. 15, the rotary 102 rotates by substantially one-quarter revolution in the direction indicated by an arrow B (FIG. 3) from a state in which the development device 18*a* (yellow) is executing the development process at the development position. Subsequently, the development device 18*b* (magenta) completes the development process.

During the development process (~s1), the development device 18*a* exists at the development position and the development bias voltage of −350V (Vdc1) is applied to the development roller 182*a*. Furthermore, the charge bias voltage (Vpri) of −1,050 V is applied to achieve the photosensitive drum surface potential of −500 V. Furthermore, the back contrast of 150 V (Vback1), which is appropriate for the development process, is set.

After the development process by the development device 18*a* (yellow) is completed at the timing s1, the control device 9 starts driving the rotary 102 to move the next color (magenta) development device 18*b* to the development position. The control device 9 starts changing the development bias voltage from −350 V (Vdc1) to −200 V (Vdc2) at the same time as the start of the driving of the rotary 102. However, in the image forming apparatus according to the present exemplary embodiment, the drive speed of the rotary 102 reaches the target speed of 240 mm/s only after the development abutment at a timing s3 is completed at a timing s4.

Accordingly, the rotary drive speed during the development separation (s2)~(s3) becomes either speed achieved during time up to a timing at which the target speed of 240 mm/s is achieved. Therefore, the back contrast optimum for preventing the separation fogging may sequentially change during time period from the start of the development separation to the end thereof.

More specifically, the relative speed of the surface moving speed of the development roller 182 with respect to the surface moving speed the photosensitive drum 2 changes in the range of 60 mm/s to 300 mm/s before the surface moving speed of the rotary 102 reaches the target speed of 240 mm/s. In other words, it is useful to gradually increase the back contrast while the surface moving speed of the rotary 102 is accelerated.

In the image forming apparatus according to the present exemplary embodiment, the control device 9 executes control for gradually changing the development bias voltage from −350 V to −200 V in conjunction with the acceleration of the rotary 102 to always maintain the optimum back contrast for preventing the separation fogging while the rotary 102 is being accelerated.

At a timing s4, the control device 9 shuts off the development bias voltage as soon as the surface moving speed of the rotary 102 reaches the target speed of 240 mm/s. After that, the rotary 102 keeps moving and the electric contacts of the image forming apparatus main body and the development device 18*a* are separated from each other at a timing s5.

Subsequently, at a timing s6, the electric contacts of the image forming apparatus body abuts on the electric contacts of development device 18*b* to achieve the conducting state.

At a timing s7, the control device 9 starts decelerating the rotary 102 by decreasing the surface moving speed of the rotary 102 from 240 mm/s until the rotary 102 stops. At timings s8 and s9, the development device 18*b* (magenta) executes the development abutment while the rotary 102 is decelerated. During this time period, the relative speed of the surface moving speed of the development roller 182 with respect to the surface moving speed of the photosensitive drum 2 is gradually decreased from 300 mm/s to 60 mm/s. Accordingly, the back contrast optimum for preventing the abutment fogging is gradually decreased.

Therefore, to prevent the abutment fogging all through the time period in which the rotary 102 is being decelerated, it is useful to gradually decreasing the back contrast. Accordingly, at a timing s7, the control device 9 raises the development bias voltage from 0 V to −200 V (Vdc2) at the same timing as the timing of start of moving the rotary 102.

After that, in conjunction with the deceleration of the rotary 102, the control device 9 gradually changes the voltage from −200 V (Vdc2) to −350 V (Vdc1) during a time period from the timing s7 to a timing s10. More specifically, the back contrast is controlled from the level in the development separation time to reach 150 V at the timing s7. Subsequently, during the time period from the timings s7 through s10, the control device 9 gradually changes the back contrast from 300 V (Vback2) to 150 V (Vback1).

The driving of the rotary 102 stops and the development bias voltage reaches −350V (Vdc1), which is optimum for image forming at the timing s10, the control device 9 starts the development process of the development device 18*b*.

The above-described operations are applied at the timing of the development contact of the development device 18*a* (yellow), at the timing of the changing from the development device 18*b* (magenta) to the development device 18*c* (cyan), at the timing of the changing from the development device 18*c* (cyan) to the development device 18*d* (black), and the development separation of the development device 18*d* (black).

In the experiment conducted by the inventor, during image forming executed in the above-described manner, neither abutment/separation fogging nor a smear on the backside of the sheet material occurred.

In the present exemplary embodiment, the development abutment/separation are executed as the operations during the development process. However, the above-described sequence for preventing the abutment/separation fogging can be applied at any other timings of the development abutment/separation.

In the first through the fourth exemplary embodiments described above, to prevent abutment/separation fogging, the control device 9 increases the back contrast by changing either one of the development bias voltage and the charge bias voltage. However, the present invention is not limited to this. Specifically, the control device 9 can increase the back contrast by changing both the development bias voltage and the charge bias voltage.

In addition, to effectively prevent the abutment/separation fogging, it is necessary to increase the back contrast during the development abutment/separation up to a value higher than the value achieved during the development process. Accordingly, it is useful only if the correlation among the values of the charge bias voltage, the surface potential of the photosensitive drum, and the development bias voltage is maintained. In other words, the values are not limited to the values described in the exemplary embodiments of the present invention described above.

In addition, in the image forming apparatus according to the first through the fourth exemplary embodiments, the surface moving speed of the rotary 102 is 240 mm/s only. However, the present invention is not limited to this. More specifically, a plurality of surface moving speeds can be set for the rotary 102.

If a plurality of moving speeds is set for the rotary 102 of the image forming apparatus, the optimum back contrast for preventing the abutment/separation fogging may differ according to different moving speeds. Accordingly, the control device 9 can control the back contrast to be different corresponding to each different surface moving speed.

Now, a case where the image forming apparatus includes the rotary 102 having the two different surface moving speeds, i.e., 240 mm/s and 120 mm/s, will be described below. More specifically, when the moving speed of the rotary 102 is at 120 mm/s, the relative speed of the surface moving speed of the development roller 182 with respect to the surface moving speed of the photosensitive drum 2 becomes lower than that when the surface moving speed of the rotary 102 is at 240 mm/s by the level equivalent to 120 mm/s. Accordingly, the optimum back contrast for preventing the contact/separation fogging becomes lower by the amount equivalent thereto.

Accordingly, the control device 9 controls the back contrast when the rotary 102 moves at the surface speed of 120 mm/s to become lower than the back contrast when the surface moving speed of the rotary 102 is at 240 mm/s. For example, the control device 9 can control the back contrast when the rotary 102 moves at the surface moving speed of 240 mm/s to be at 300 V while controlling the back contrast when the rotary 102 moves at the surface moving speed of 120 mm/s to be at 200 V, which is lower than 300V.

In the first through the third exemplary embodiments of the present invention, a method that uses reversal development, in which the developer is negatively charged, is described. However, if the normal development method for positively charging the developer is used, the difference between the potential on the surface of the development roller and the after-exposure potential can be used as the back contrast.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-140911 filed Jun. 21, 2010, which is hereby incorporated by reference herein in its entirety.

What is claimed is:

1. An image forming apparatus comprising:

a rotatable image bearing member configured to bear an electrostatic latent image;

a plurality of development devices, each device including a developer bearing member configured to bear a developer for developing the electrostatic latent image;

a rotatable development device supporting member configured to support the plurality of development devices, wherein the developer bearing member is configured to execute development while contacting the image bearing member at a development position via the developer, wherein the developer bearing member rotates in the same direction as a rotating direction of the image bearing member at the development position and a surface moving speed of the developer bearing member is faster than a surface moving speed of the image bearing member, wherein the development device supporting member rotates so that the development device supporting member changes a developer bearing member existing at the development position to another developer bearing member, and wherein a first relative speed of a surface moving speed of the developer bearing member with respect to a surface moving speed of the image bearing member when the developer bearing member is about to abut on or is about to separate from the image bearing member becomes higher than a second relative speed of the surface moving speed of the developer bearing member with respect to the surface moving speed of the image bearing member when the electrostatic latent image is developed; and wherein a first potential difference is a potential difference during the first relative speed between a potential of a bias applied to the developer bearing member when the developer bearing member is about to abut on or is about to separate from the image bearing member and a potential of a non-image area of the image bearing member when the electrostatic latent image is developed, wherein a second potential difference is a potential difference during the second relative speed between the potential of the bias applied to the developer bearing member when the electrostatic latent image is developed and a potential of a non-imaging area of the image bearing member when the electrostatic latent image is developed, wherein the first potential difference is higher than a second potential difference.

2. The image forming apparatus according to claim 1, wherein the control unit is configured to discontinue applying a development bias when an electric contact provided to the development device configured to apply a bias to the developer bearing member separates from an electric contact provided to an image forming apparatus body by a rotation of the rotatable development device supporting member.

3. The image forming apparatus according to claim 1, wherein the control unit is configured to switch from the second potential difference to the first potential difference after a region of the image bearing member in which the electrostatic latent image to be developed on a recording sheet has past the development position and before a region of the image bearing member corresponding to a margin of the recording sheet at a trailing edge of the recording sheet passes the development position.

4. An image forming apparatus comprising:

a rotatable image bearing member configured to bear an electrostatic latent image;

a plurality of development devices, each device including a developer bearing member configured to bear a developer for developing the electrostatic latent image;

a rotatable development device supporting member configured to support the plurality of development devices, wherein the developer bearing member is configured to execute development while contacting the image bearing member at a development position via the developer, wherein the developer bearing member rotates in the same direction as a rotating direction of the image bearing member at the development position and a surface moving speed of the developer bearing member is faster than a surface moving speed of the image bearing member, wherein the development device supporting member rotates so that the development device supporting member changes a developer bearing member existing at the development position to another developer bearing member, wherein movement of the development device supporting member when the developer bearing member is about to abut on or is about to separate from the image bearing member includes a first movement and a second movement, in which a component of a speed in a tangential direction with respect to the image bearing member at the development position is greater than a component of a speed in a tangential direction with respect to the image bearing member at the development position in the first movement, and wherein either one of an abutment and a separation when the developer bearing member is about to abut on or is about to separate from the image bearing member is the first movement and the other is the second movement; and a control unit configured to control a third potential difference and a fourth potential difference to be different from each other, wherein the third potential difference is a potential difference between a potential of a bias applied to the developer bearing member during the first movement and a potential of a non-image portion of the image bearing member at the development position, and wherein the fourth potential difference is a potential difference between a potential of a bias applied to the developer bearing member during the second movement and a potential of a non-image portion of the image bearing member at the development position, wherein the third potential difference is greater than a back contrast during image formation between a potential of a bias applied to the developer bearing member at the development position and a potential of a non-image portion of the image bearing member at the development position.

5. The image forming apparatus according to claim 4, wherein the control unit is configured to discontinue applying a development bias when an electric contact provided to the development device configured to apply a bias to the developer bearing member separates from an electric contact provided to an image forming apparatus body by a rotation of the rotatable development device supporting member.

6. The image forming apparatus according to claim 1, wherein a bias applied to the developer bearing member when the developer bearing member abuts on or separates from the image bearing member is not an image forming bias.

* * * * *